US005310172A

United States Patent [19]

Prim et al.

[11] Patent Number: 5,310,172

[45] Date of Patent: May 10, 1994

[54] HOPPER LOADER

[75] Inventors: John E. Prim, West Chazy; David Hall, Plattsburgh; Robert Kinson, Plattsburgh; Cyrus Myers, Plattsburgh, all of N.Y.

[73] Assignee: Prim Hall Enterprises Inc., Plattsburgh, N.Y.

[21] Appl. No.: 978,994

[22] Filed: Nov. 19, 1992

Related U.S. Application Data

[62] Division of Ser. No. 693,638, Apr. 30, 1991, Pat. No. 5,197,590.

[51] Int. Cl.[5] ..... B65H 1/02

[52] U.S. Cl. ..... 271/150; 271/31.1

[58] Field of Search ..... 271/146, 149-151, 271/31.1, 31

[56] References Cited

U.S. PATENT DOCUMENTS

| | | | |
|---|---|---|---|
| 3,945,633 | 3/1976 | Knopp | 271/150 |
| 4,366,955 | 1/1983 | Pessina et al. | 271/150 |
| 4,588,180 | 5/1986 | Ballestrazzi et al. | 271/150 |
| 4,757,985 | 7/1988 | Hamant et al. | 271/149 |
| 4,911,421 | 3/1990 | Hannon | 271/151 |
| 4,973,038 | 11/1990 | Curley et al. | 271/150 |
| 4,981,292 | 1/1991 | Cosgrove | 271/150 |
| 5,116,039 | 5/1992 | Braen et al. | 271/149 |
| 5,211,529 | 5/1993 | Esala et al. | 271/150 |

*Primary Examiner*—H. Grant Skaggs
*Attorney, Agent, or Firm*—Louis Weinstein

[57] ABSTRACT

For use with a hopper loader a quick-release feed rack having two swingable sections coupled through a center pivot enables removal of one section for quick and simple attachment to a loader.

17 Claims, 16 Drawing Sheets

Fig. 1e
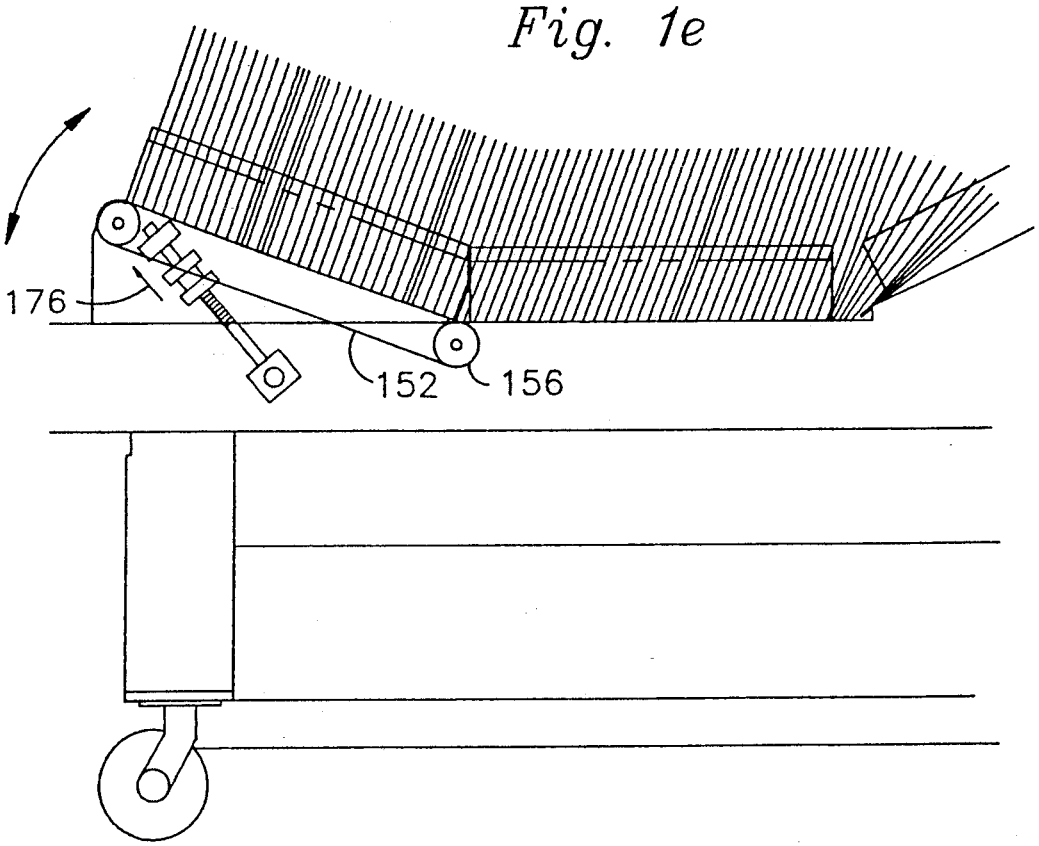
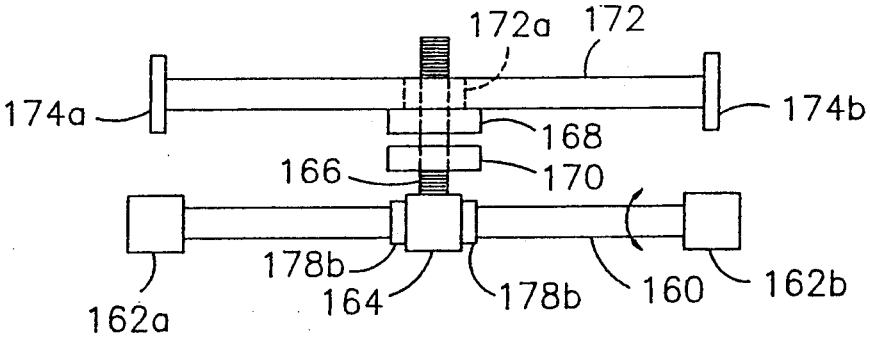
Fig. 1f

HOPPER LOADER

CROSS-REFERENCE TO THE RELATED APPLICATION

This is a division of application Ser. No. 07/693,638, filed Apr. 30, 1991, now U.S. Pat. No. 5,197,590, issued Mar. 30, 1993.

FIELD OF THE INVENTION

The present invention relates to hopper loaders and more particularly, to a novel improved hopper loader having unique features which greatly facilitate both set-up and use thereof.

BACKGROUND OF THE INVENTION

Loaders are well known to the art and are used in a variety of different segments within the fields of printing and publishing. For example, feeders are utilized to feed signatures one at a time from a hopper onto a conveyor; are used to supply signatures to a hopper; and are used to supply signatures to a signature feed assembly which, in turn, delivers partially opened signatures one at a time to a saddle conveyor, to name just a few applications. In all of the above-identified applications, it is necessary to provide signature streams and/or signature stacks which are in proper alignment to facilitate trouble-free transfer to the utilization device receiving signatures from the feeder.

In addition, when stacking signatures side-by-side preparatory to their transfer to an output utilization device, it is extremely important that the signatures be aligned so that they do not exert undue forces on the output utilization device thereby causing undesirable misfeeds.

In addition to the above, it is also important to provide feeders which not only have the versatility enabling the feeder to accommodate a variety of different signature sizes but also have the ability to permit rapid adjustment of the feeder when changing from one feeder size to another or when changing the coupling of the feeder output from one output utilization device to another.

The complicated nature and construction and the operating features of present day feeders increase the possibility of jams or other malfunctions during use and require complicated set-up operations, significantly increasing the cost of equipment as well as the cost of operating the equipment.

BRIEF DESCRIPTION OF THE INVENTION

An improved feeder which overcomes the above-mentioned disadvantages as well as providing other distinct advantages is characterized by comprising a horizontal conveyor section at the infeed for receiving signatures either manually or from an outfeed conveyor. The downstream end of the horizontal conveyor transfers signatures placed in a near-vertical orientation to an inclined ramp conveyor which typically operates at either the same or a greater linear speed than the horizontal conveyor, serving to separate the signatures and to arrange them in a shingled stream. The output end of the inclined ramp conveyor delivers the shingled stream to a short conveyor section which is typically aligned to advance the signatures delivered thereto either horizontally into a hopper or diagonally downward for insertion into any one of a variety of output utilization devices and typically oriented at an acute angle to the vertical.

Side guides are provided along the opposite parallel sides of the feeder to maintain the alignment of signatures as they move from the input to the output end thereof. Adjustable side guides are utilized to accommodate signatures of different sizes and align them with an output utilization device. A novel side guide mechanism is provided on at least one side of the feeder for adjusting a one-piece side guide extending the entire length of the feeder through a single operating handle. Two such side guide cams may be provided, one along each side of the feeder for applications in which the product register is the centerline of the machine. Alternatively, a fixed guide may be used along one side of the feeder if the fixed side of the loader is employed for product registry. The side guide cam comprises an elongated threaded assembly ("worm") comprised of linear threaded sections for each of the horizontal, ramp and output conveyor sections the adjacent ends of which are joined end-to-end by universal joints. Links pivotally coupled to threaded nuts threadedly engaging the elongated worm member are caused to pivot about a point intermediate their ends by means of a second link fixedly secured at one end to said threaded member and pivotally coupled to a point intermediate the ends of said first-mentioned coupling link. A pair of such linkages are arranged respectively near the input and output ends of the feeder and by rotation of the elongated threaded member by rotation of a crank handle the side guide may be rapidly adjusted to accommodate signatures of any size within a predetermined range thus significantly reducing set-up time.

The horizontal infeed conveyor section is provided with an adjustable hand-feed conveyor section provided at the input end thereof. The section is provided with an adjustable hand-feed frame assembly which may be adjusted to any desired angular position between horizontal alignment and one forming an acute angle to the horizontal alignment. The adjustable hand-feed frame section includes conveyor means driven by and in synchronism with the main conveyor section. The inclined section greatly simplifies the manual loading of signatures. An operator can place stacks of signatures which are hand-carried to the feeder in a rapid and simple manner without the exercise of careful, tedious attention to the stacking of signatures thereon since the inclination of the hand-feed frame assembly holds the signatures deposited thereon generally upright, greatly facilitating the operation of depositing signatures thereon by an operator. The adjustable frame assembly holds a substantial number of signatures providing a buffer storage enabling the person loading the feeder to fill another feeder thereby enabling a single operator to feed multiple loaders. In addition, the angle of inclination may be adjusted to accommodate the operator's height, thereby significantly reducing operator fatigue by reducing the amount of bending experienced by the operator during hand-feeding of the feeder. The hand-feed frame assembly is further capable of being collapsed to the horizontal position enabling the feeder to be interfaced with an outfeed conveyor for use in an automatic feeding application, which typically accepts bundled signatures.

Alignment and precision adjustment of the feeder with a hopper is accomplished by means of an electrically powered positioning actuator mounted near the lower end of the downstream legs supporting the feeder and extending toward the supporting structure for the hopper which will receive signatures from the feeder upon connection therewith. The forward free-end of the positioning actuator extends into a clevis bracket having a manually releasable self-locking member for automatically and precisely positioning the forward free end of the positioning actuator relative to the hopper assembly. The positioning actuator is operated by a control panel which moves the free end of the positioning actuator either inward or outward relative to the feeder to adjust the output end of the feeder relative to the hopper enabling adjustment between a range of sizes between a maximum and minimum product size. This technique totally eliminates the need for the prior art coupling method which requires loosening of a manually operable locking handle and rolling the entire loader (which typically weighs approximately 1,000 pounds) into proper position and thereafter tightening the locking handle.

Alignment in the horizontal direction is obtained by providing guide channels which are accurately positioned relative to the hopper and clevis bracket in order to automatically provide spatial alignment in the horizontal plane simply by rolling the feeder wheels into the guide channels.

The feeder operating panel is provided with a toggle switch having a normal center position and being selectively movable in either opposing direction from the center position to respectively control movement of the feeder either closer to or further away from the hopper. The operating motor advances the positioning actuator in 1/16 inch increments enabling the feeder jogger to be accurately positioned within the hopper to produce a neat pile as well as permitting utilization of the actuator for a set-up in which the product format is changed.

The feeder control panel is mounted at the free end of a rotatable control arm or "boom" which is rotatably mounted through coupling means to one side of the feeder frame. The control panel is rotatably mounted to the free end of the boom to enable the control panel to be readily and simply positioned on either side of the feeder with the face of the control panel along which the displays and manually operable control members are mounted facing away from the feeder thereby greatly facilitating control of the feeder by an operator. For example, assuming that equipment or other obstacles are in close proximity to one side of the feeder, the control panel may be simply swung to the other side of the feeder and the control panel itself rotated so that the control panel face containing displays and control knobs may be readily accessed by the operator.

When setting the positioning actuator, the fine-tuning of the feeder relative to the hopper may be accomplished as the hopper is being operated thus assuring that the positioning alignment directly results in smooth, uniform feeding of signatures from the hopper.

The positioning actuators of a plurality of feeders may be simultaneously operated from a single, main control unit which is utilized during the make-ready phase to move all of the loaders at one time. This is accomplished by coupling all of the positioning actuators to a single control unit. In one embodiment, the main controller may move each feeder in the same direction through small (i.e. 1/16 inch increments). However, in order to accurately position all of the feeders relative to their associated hoppers (for example) and wherein the individual feeders may be located at differing distances from their associated hoppers, adjustable stops may be provided whereupon movement of each feeder controlled by its positioning actuator is continued until a sensor, such as a limit switch strikes the desired stop. This technique is extremely advantageous when multiple adjustments of a plurality of feeders are desired in a system in which two product sizes are run more predominately or exclusively as compared with other product sizes.

In applications where it is desired to adjust a plurality of feeders to any one of an infinite number of positions within the range of maximum to minimum product size, a value representative of product size is dialed into the control unit and to generate a voltage proportional to product size which is compared against an analog value generated by a linear proximity switch (which measures the distance between feeder and hopper) to determine the difference and direction between the present setting of each linear actuator and the dialed-in product size whereupon the linear actuator is moved to the desired position. The comparison operations and energization of the linear actuators may be performed either simultaneously or sequentially, the latter being performed in a high speed manner.

Sensor means are provided to determine when the hopper receiving signatures from the feeder is loaded to a proper height. In order to prevent misfeeds or jams, the sensor automatically turns off the feeder when the pile of signatures reaches a desired maximum height. The feeder is not turned on again until the height of the signature stack has lowered to a predetermined point. As signatures make the transition from the horizontal conveyor to the ramp conveyor, pressurized air is directed toward the signatures to separate the signatures and assure the formation of a neat shingled stream along the ramp conveyor. In order to conserve energy, the signal automatically turning off the feeder is utilized to set a timer to control a shut-off valve decoupling the air blast system after the timer is timed out in order to save energy.

Product joggers which jog the product as it is being collected in the hopper are likewise automatically shut off by control means which turns off the joggers a predetermined time delay after the feeder has stopped running in order to save operating energy and to further prevent "over jogging" of the product during turn-off periods of the feeder which can damage the signature.

When it is desired to couple the feeder to a saddle hopper feedrack, existing feeders necessitate the removal of the feedrack from the saddle stitcher which operation is a labor, intensive, time-consuming procedure. The present invention provides a sectional feedrack assembly which pivots in the center allowing for a very simple installation of the feeder. The feedrack is formed in two sections, one section pivoting relative to the other for alignment therewith when used in the manual feed mode and swingable downwardly and out of the way of a feeder when the feedrack is to be coupled to a feeder for automatic feeding. The feedrack length is thus reduced which is advantageous since a loader interfaced to an existing ("long") rack presents a product pile which is too large, producing excessive pressure on the hopper, thereby significantly reducing the ability of the hopper to operate smoothly and properly.

The feeder is provided with a jogger mechanism referred to as a beaver-tail jogger to form a neat pile of signatures in the hopper. In order to facilitate adjustment of the jogger paddle to prevent excessive pressure on the jogger which can damage the signatures, overload the jogger and lead to destruction thereof, the beaver-tail jogger mechanism is provided with a "micro" adjustment system wherein the jogger paddle is raised or lowered by means of a threaded rod operable by a hand wheel which, when rotated, moves a block threadedly engaging said threaded rod either downwardly or upwardly through a fine adjustment to thereby locate the beaver-tail jogger paddle at the desired location thereby "fine-tuning" the jogger to obtain a neat pile within the hopper.

All the above features cooperate to provide a feeder which is easier to set up and operate, which provides significantly improved operating performance all of which features are obtained at a significantly reduced operating cost.

OBJECTS OF THE INVENTION

It is, therefore, one object of the present invention to provide a feeder which is easy to set up and may be set up preparatory to a run in a fast and simple manner.

Still another object of the present invention is to provide a novel feeder having a positioning actuator which provides for high speed set-up and accurate positioning of a feeder relative to a hopper receiving signatures from the feeder.

Still another object of the present invention is to provide novel automatic positioning means for simultaneously adjusting a plurality of feeders relative to their associated output hoppers through the use of single control means.

Still another object of the present invention is to provide a novel control means for adjusting a feeder relative to an output utilization device and employing a positioning actuator controlled by automatic positioning means.

Still another object of the present invention is to provide a novel control means for adjusting a feeder relative to an output utilization device and employing a positioning actuator controlled by automatic positioning means including adjustable positioning devices which may be preset according to the predominant product sizes being run.

Still another object of the present invention is to provide novel means for automatically shutting off the feeder air blast system at a predetermined time delay after the feeder is turned off to conserve energy.

Still another object of the present invention is to provide a novel feeder assembly having means for automatically shutting off the feeder jogging means a predetermined time interval after the feeder has turned off to save energy and prevent "over jogging" of the product, as well as preventing damage to the jogger.

Still another object of the present invention is to provide a feeder having novel adjustable side guides to facilitate simple, rapid adjustment thereof to accommodate different product sizes.

Still another object of the present invention is to provide a feeder having novel adjustable side guides to facilitate simple, rapid adjustment thereof to accommodate different product sizes and wherein said adjustment means utilizes a single operating handle.

Still another object of the present invention is to provide a feeder assembly provided with a novel hand-feed section which is adjustably movable between horizontal position to accommodate automatic feeding of signatures to the feeder and an inclined position to facilitate hand-feeding.

Still another object of the present invention is to provide a feeder assembly provided with a novel hand-feed section which is adjustably movable between a horizontal position to accommodate automatic feeding of signatures to the feeder and an inclined position to facilitate hand-feeding and wherein the inclined angle of the hand-feeder frame assembly may be adjusted to accommodate operators of different sizes.

BRIEF DESCRIPTION OF THE FIGURES

The above, as well as other objects of the present invention, will become apparent when reading the accompanying description and drawings in which:

FIG. 1*e* is an elevational view showing a portion of the feeder of FIG. 1 and showing the adjustable hand-feed conveyor assembly in greater detail;

FIG. 1*f* shows an end view of the adjustment assembly for adjusting the angle of inclination of the hand-feed conveyor section of FIGS. 1*d* and 1*e;*

DETAILED DESCRIPTION OF THE INVENTION

Figure 1:
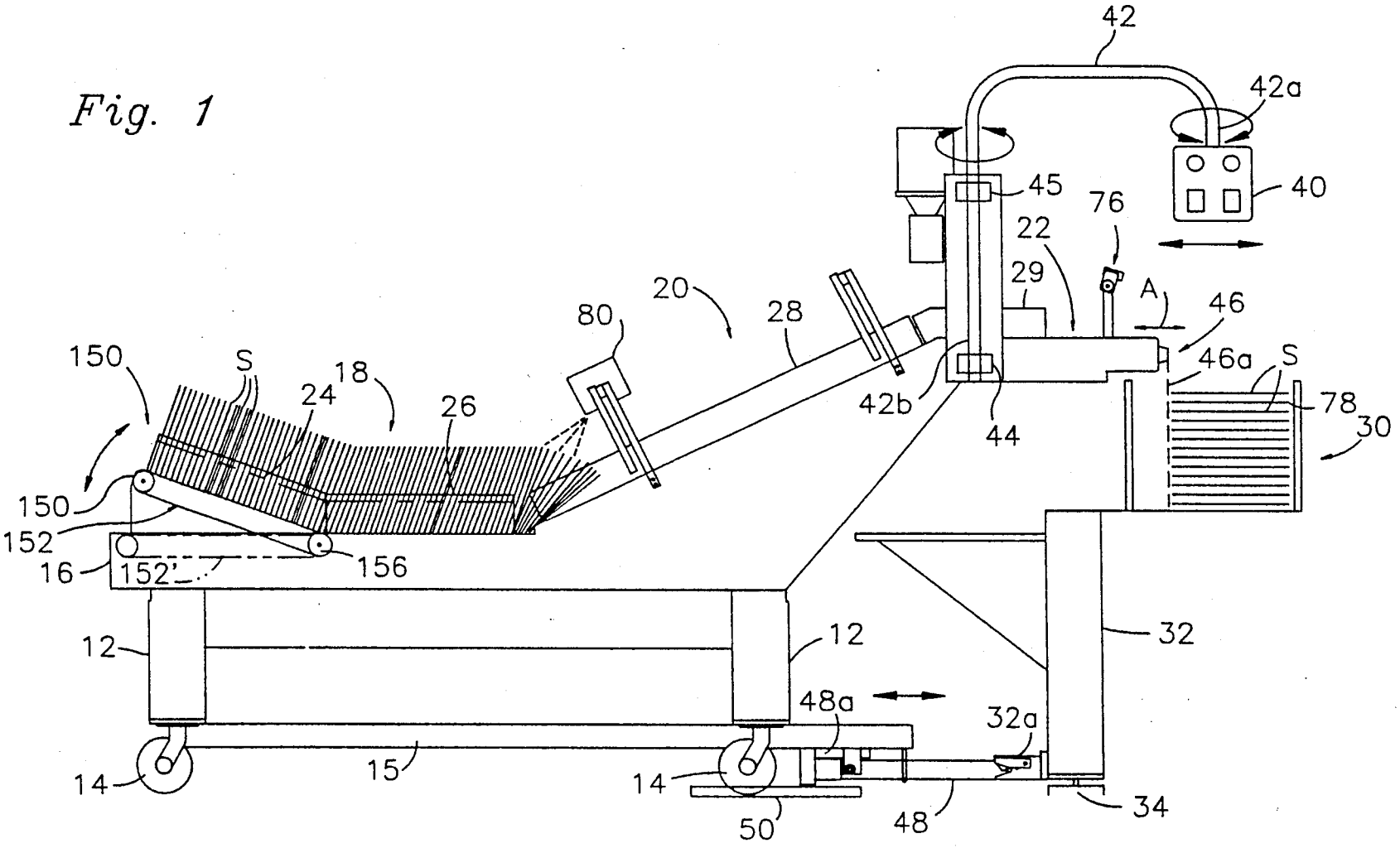
FIG. 1 shows a schematic elevational view of a feeder assembly embodying the principles of the present invention.

FIG. 1 shows a feeder 10 supported on four legs 12 (only two of which are shown in the Figure), each leg being provided with a caster assembly 14 for rollingly supporting feeder 10 to facilitate easy movement. The legs 12 support a frame 16 which houses the motor drives and related mechanisms for driving the horizontal conveyor section 18, the ramp conveyor section 20 and an outfeed conveyor section 22. Legs 12 are provided with manual handwheels for adjusting the height of the conveyor sections relative to hopper 30, for example. Signatures S are delivered to the horizontal conveyor section either automatically by means of an outfeed conveyor (not shown) arranged immediately adjacent the left-hand end of the conveyor section 18, or manually. As signatures are delivered to the ramp conveyor they rest against the ramp conveyor belts (only belt B being shown in FIG. 1 for purposes of simplicity) and move upwardly therealong, forming a shingled stream. The shingled stream of signatures reach and thereafter move along the conveyor belts of the outfeed conveyor section 22. Each signature moves off of the outfeed conveyor section 22 and falls into a hopper 30 coupled to feeder 10. The hopper 30 is provided with a support 32 mounted upon the floor and preferably precisely located thereon by a positioning pin (or pins) 34 (FIG. 1*c*), such as a lag bolt, which facilitates accurate positioning of the hopper and the feeder coupled thereto in a manner to be more fully described.

The signatures fall into hopper 30 oriented in a substantially horizontal plane. The hopper delivers signatures in a one-at-a-time fashion into an output utilization device (not shown). In order to assure proper signature feeding from hopper 30 it is important to form a neat signature stack therein. The alignment of signatures within the feeder and the adjustment of the feeder relative to the hopper significantly contribute to accurate, error-free operation and it is important to provide apparatus which assures the desired alignment and positioning of components as well as guidance of the signatures throughout the feeding and stacking operation. For example, the feeder 10 is provided with side guides including side guide sections 24, 26, 28 and 29 which are provided along opposite longitudinal sides of the feeder, the side guides of only one side of the feeder being visible in FIG. 1, the side guides assuring proper alignment of the signatures in the horizontal plane and within hopper 30. Adjustable side guides are provided as will be described more fully hereinbelow in order to accurately align the signatures in the feeder relative to the output hopper as well as greatly facilitating set-up of the feeder when changing to a different product size.

The feeder is provided with a control panel 40 having a variety of control buttons and displays. The control panel is easily accessible from one side of the feeder as shown in FIG. 1 as well as the top plan view shown in FIG. 1*a*. The control panel 40 is mounted to the free or right-hand end 42*a* of a rotating control arm or boom 42 having an inverted J-shape which has its lower left-hand end 42*b* rotatably mounted within a cup assembly 44. A pivot coupling 45 rotatably mounts an upper portion of section 42*b*. Control panel 40 is rotatably coupled to the end 42*a* of boom 42 by means of a bearing assembly 43 (not shown in detail) arranged within the upper portion of the control panel housing.

Summarizing, the lower end of boom 42 fits within a pivot cup 44 having a suitable bearing for rotatably mounting boom 42 therein. A pivot block 45 is mounted along the machine frame a spaced distance above pivot cup 44. The lower end of boom 42*b* pivots within suitable bearing means in pivot cup 44. A pivot block 45 arranged a spaced distance above pivot cup 44 provides a similar bearing assembly and cooperates with pivot cup 44 to prevent any movement by boom 42 other than about its longitudinal vertical axis.

Figures 1A, 1D:
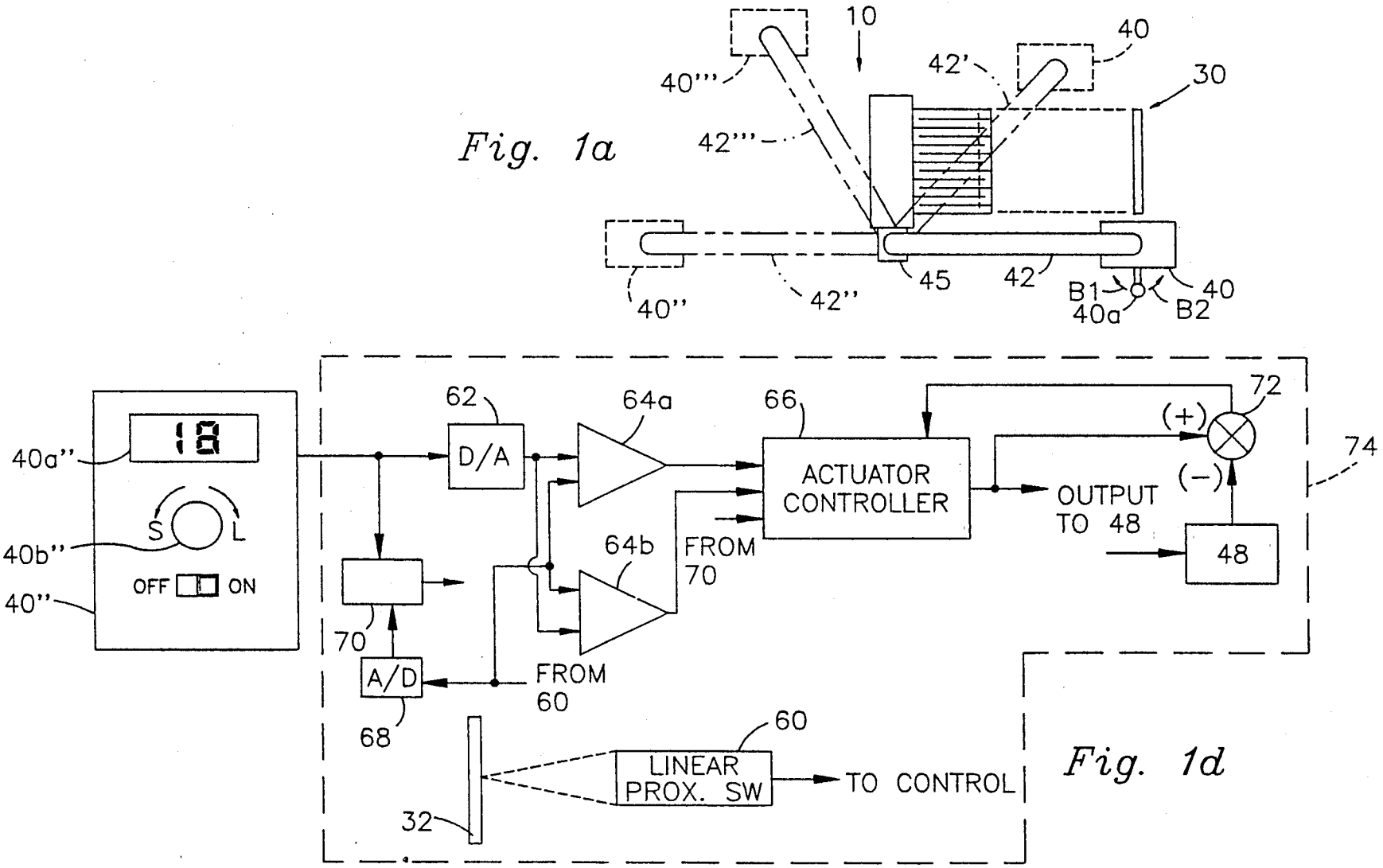
FIG. 1*a* shows a top plan view of a portion of the feeder of FIG. 1 showing the adjustable boom and control panel in greater detail.
FIG. 1*d* shows a block diagram of an electrical control circuit for operating the linear actuator as shown in FIGS. 1 and 1*b;*

In the event that feeder 10 is positioned in close proximity to adjacent equipment or other objects which serve as an obstacle preventing an operator from gaining access to the control panel when positioned in the manner shown in solid line fashion in FIG. 1*a*, the boom may be rotated about couplings 44–45 from the solid line position 42 to the dotted line position 42' shown in FIG. 1*a*. Control panel 40 may then be rotated through approximately 180 degrees causing the control panel knobs and display to be facing away from the feeder 10 and hopper 30 to facilitate access to and operation of the control panel. The height of the boom is sufficient to permit the boom and control panel to be rotated either clockwise or counterclockwise through 360 degrees without interfering with or colliding with any of the feeder or hopper assembly components. FIG. 1*a* shows further orientations which the boom and control panel may assume during operation of the feeder. Note positions 40''–42'' and 40'''–42'''.

As was described hereinabove, it is extremely important to properly align the feeder relative to the hopper since this automatically aligns the jogger assembly 46 provided at the downstream end of the feeder and including a jogger paddle 46*a* which reciprocates at high speed in the manner shown by the double-headed arrow A serving to jog and thereby properly align the signatures S within hopper 30 to form a neat pile.

Alignment is obtained by means of a positioning actuator assembly 48 including a motor 48*a* mounted beneath a channel 15 forming part of the machine frame. The positioning actuator is secured to the underside of channel 15 and extends toward the right. The free, right-hand end of actuator 48 extends into a clevis bracket 32*a* integrally joined to hopper support 32 having a hollow interior conforming to the cross-section of the right-hand end of position actuator 48. The position actuator is provided with a pin 48*b* extending outwardly from opposite sides of the actuator with each projecting side of the pin (only one being shown in FIGS. 1 and 1*c*) being guided into the clevis bracket 32*a* by a pair of V-shaped slots 32*b* (only one being shown in FIGS. 1 and 1*c*). A spring-loaded locking or latch arm is swingably mounted to bracket 32*a* by pin 32*c* and is spring-loaded by bias means (not shown) to be urged in the counterclockwise direction about pin 32*c*. A stop pin 32*d* limits the counterclockwise travel of lever 32*e*. A nose portion of lever 32*e* is slanted at 32*e*-1 so that, when engaged by pin 48*b*, the latch lever 32*e* is urged clockwise against the force of the bias spring to move out of the way of pin 48*b*. When pin 48*b* rests against the base of the V-shaped groove 32*b*, latch lever 32*e* springs back to the solid-line position shown in FIG. 1*c* causing its shoulder 32*e*-2 to collectively embrace pin 48*b* together with the base of V-shaped slot 32*b* to retain the position actuator 48 in the proper position relative to the hopper support 32 and hence hopper 30. When it is desired to remove the feeder from the hopper assembly, this may be done simply by lifting latch lever 32*e* (i.e. moving it clockwise) through an angle sufficient to displace the latch from pin 48*b* whereupon the feeder may be pulled to the left and out of the locking mechanism.

The positioning actuator is comprised of a mechanism which moves the right-hand end of the actuator either further away from or closer to the left-hand end thereof which is secured to the frame of feeder 10. A suitable mechanically operated feeder which is comprised of a motor driving a spur gear and operating a worm gear to extend or retract the right-hand end of the assembly is the Model 5703551 Actuator produced by the Thomson-Saginaw Company. The position actuator is electrically operated by means of a toggle arm such as, for example, the toggle arm 40*a* mounted upon control panel 40 as shown in FIG. 1*a*. Toggle arm 40*a* has a neutral position as shown and may be pushed to either the left or the right as shown by arrows B1 and B2 respectively. When moving the toggle from the neutral position in the direction of arrow B1, the motor is turned on and operates the position actuator in a direction which causes the feeder to move closer to the hopper assembly 30, i.e. to move toward the minimum product size. The loader control is such that the position actuator moves in 1/16 inch increments and at a rate which is slow enough to enable operation of the toggle arm 40*a* to be moved to the left and returned to the neutral position to limit movement to just one incremental step.

By moving the toggle arm 40*a* from the neutral position toward the right as shown by arrow B2, the motor is operated in the direction which causes the feeder 10 to move further away from the hopper, i.e. in the direction toward maximum product size. By maintaining the toggle arm activated in either the left or right-hand position, the feeder will move through a number of incremental steps where alternatively by operating the toggle arm just once to the left and right and then rapidly releasing it, incremental (1/16 inch) steps may be obtained. This control enables the feeder positioning relative to the hopper to be "fine-tuned" assuring the production of neat piles within the hopper and especially preventing overloading of the jogger assembly 46. The control arrangement may also be utilized when setting up the feeder to accommodate a change in product size. Holding the lever arm in the active position for a longer time allows the actuator to advance through a plurality of 1/16 inch increments.

The alignment of the feeder 10 in the horizontal plane relative to the hopper 30 is obtained through the utilization of a pair of channel-shaped guides 50, only one of which is shown in FIG. 1, a guide being provided for each of the right-hand casters 14 of the feeder. The channel guides are preferably formed in a unitary manner having an intermediary or cross-piece member (not shown) joined between the guides to maintain them in spaced parallel fashion. The guides and joining member are then placed upon the floor and provided with positioning means for positioning the guides relative to the floor pin(s) 34 thereby properly aligning the channel guides relative to the hopper assembly. The guides may be provided with a member 51 coupled between guides 50 and pin(s) 34 to accurately position the guides relative to the pin(s). Proper alignment is thus assured by rolling the feeder assembly 10 toward the right so that each of the forward casters 14 enter one of the channel guides. The feeder is then pushed forward by an amount sufficient to cause the pin 48*b* to be locked within the clevis bracket in the manner previously described thereby assuring proper alignment. If desired, the channel guides 50 may be of a length sufficient to receive both the forward and rearward casters 14 of the feeder.

Figures 1B, 1C:
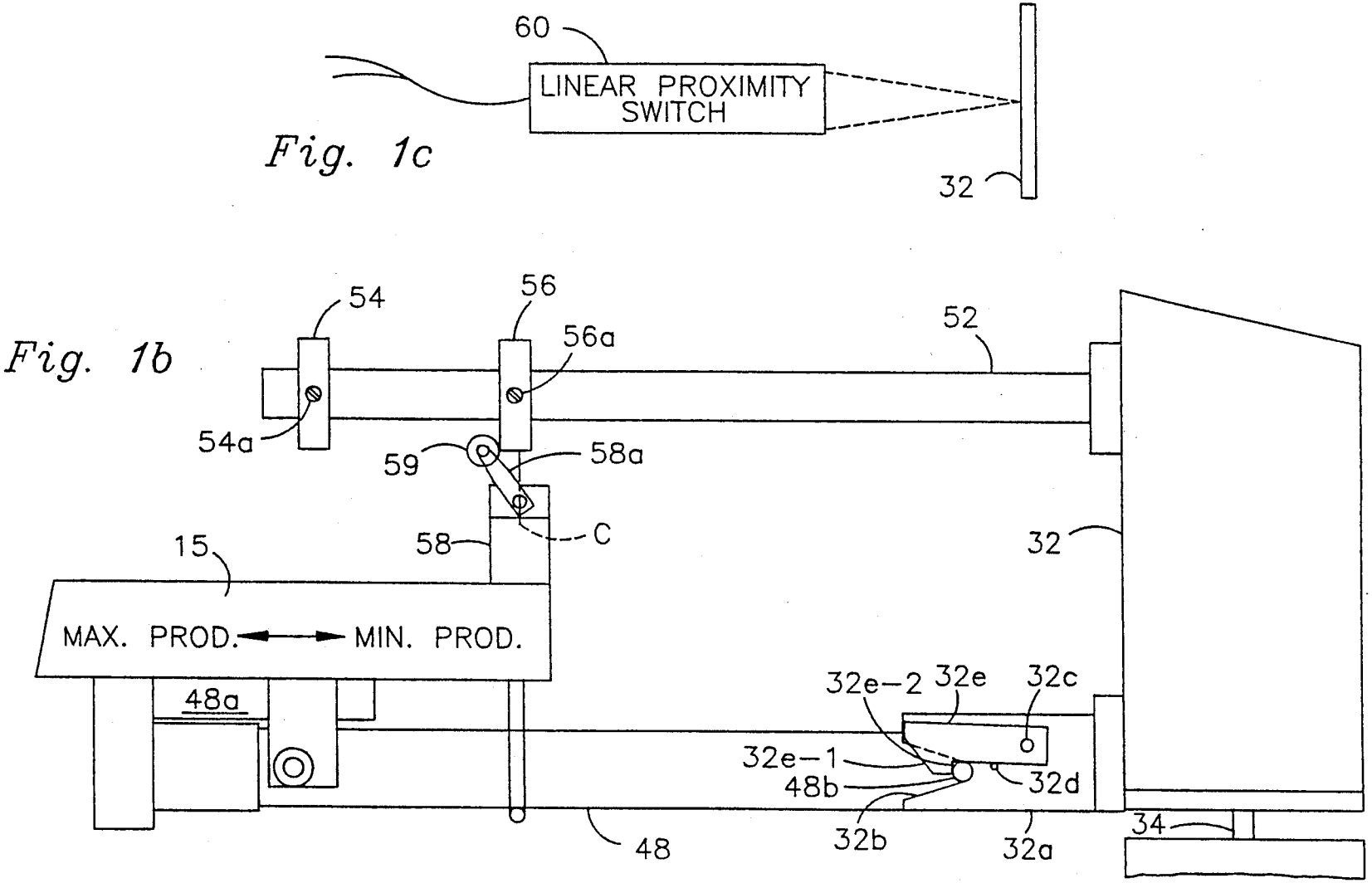
FIG. 1*b* shows a detailed elevational view of the linear actuator assembly employed in the feeder of FIG. 1.
FIG. 1*c* shows a linear proximity switch which may be employed in the embodiment of the present invention.
Figure 2:
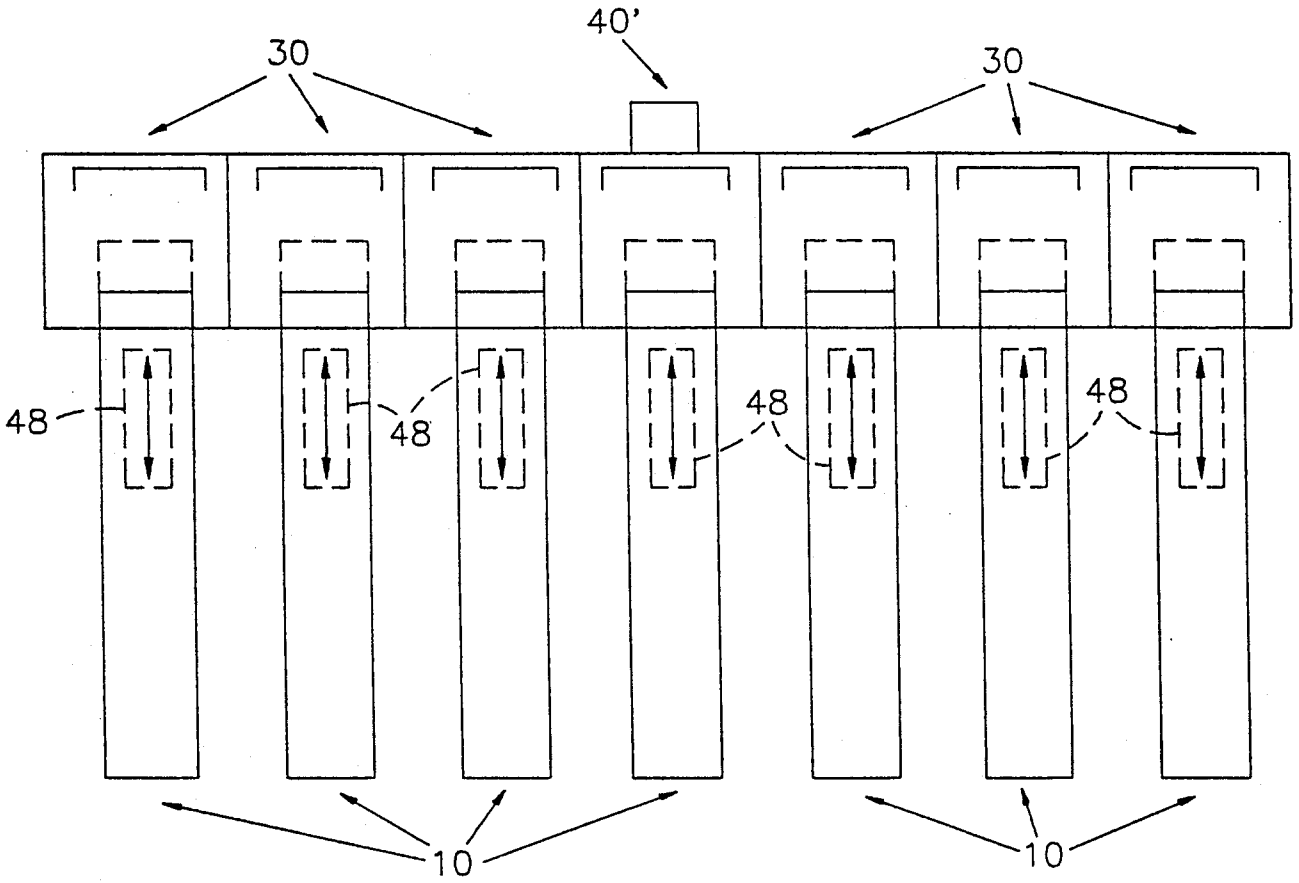
FIG. 2 is a schematic diagram showing the manner in which a plurality of feeder actuators may be operated from a single control unit.

FIG. 2 shows a plan view of a plurality of hopper loaders 10 each arranged to deliver signatures to an associated inserter hopper 30. Each feeder is provided with an associated position actuator 48 coupled to an associated clevis bracket (not shown) provided for each hopper assembly 30. A central control panel 40' is utilized to gang position all of the actuators 48 thus significantly simplifying the positioning operations for the plurality of feeders Considering FIGS. 1*c* and 2, each hopper assembly support frame is provided with an elongated rod 52 integrally joined thereto and extending in a direction toward the feeder. Rod 52 is provided with a pair of adjustable stops 54, 56 slidably arranged along rod 52. For example, rod 52 may be circular or rectangular in cross-section and stops 54 and 56 provided with openings conforming to the cross-section of rod 52. Set screws 54*a*, 56*a* threadedly engage threaded openings within stops 54 and 56 to secure the adjustable stops at desired positions along the length of rod 52. A limit switch 58 is mounted to the channel 15 of each feeder 10 and is provided with a swingably mounted switch arm 58*a* having a roller 59 at its free end. Switch arm 58*a* is biased by suitable bias means (not shown) so as to be normally vertically oriented. When moved either clockwise or counterclockwise from the vertical orientation represented by the dotted centerline C, limit switch 58 automatically turns off actuator motor 48*a*. The manner in which the ganged operation of the feeders is accomplished as follows:

Control panel 40' is preferably provided with a toggle arm 40*a* of the type shown in FIG. 1*a*. By moving the toggle arm of the control panel toward the maximum product direction, the motors 48*a* of all of the feeders 10 are simultaneously energized and moved in a direction causing the feeders to move away from their associated hoppers, i.e. toward the maximum product size direction. Limit switch arm 58*a* is maintained in the vertical position. As soon as the roller 59 of each switch arm engages stop 54, the switch arm is caused to rotate clockwise against the bias force of the internal spring provided within limit switch 58 causing the limit switch to turn off actuator motor 48*a*. Each actuator motor will be turned off as soon as its associated limit switch hits the maximum product stop 54. The reverse operation may be obtained by operating the toggle arm to cause the actuators of each feeder 10 to move closer toward its associated hopper, i.e. toward the minimum product size, whereupon when switch arm 58*a* engages stop 56, it is urged away from the normal vertical position and moves in the counterclockwise direction against the force of the internal bias spring whereupon the limit switch causes its associated actuator motor to be turned off. Even assuming that the feeders 10 are aligned at different positions relative to the desired end position, only a single operation of the control panel toggle arm is required since the limit switch provided on each feeder automatically stops the feeder at the desired product size regardless of the distance travelled by each actuator in reading the desired position. The embodiment of FIG. 1*c* is extremely advantageous for use when only two product sizes are being run or alternatively when two product sizes are run more frequently than other product sizes.

If desired, the rod 52 may be mounted upon feeder 10 and the limit switch may be mounted upon the hopper supporting structure. The same is also true of actuator 48, i.e. clevis bracket 32*a* may be mounted upon feeder 10 and actuator 48 upon hopper support 32.

In applications wherein it is desired to obtain any one of an infinite number of positions between maximum and minimum product sizes, the limit switch 58 and rod 52 and cooperating adjustable stops 54 and 56 may be eliminated and replaced by a linear proximity switch 60 as shown in FIG. 1*d*. The linear proximity switch is mounted upon feeder 10, for example, in the position occupied by limit switch 58 shown in FIG. 1*c* and detects surface 32, for example, or alternatively, an element provided on surface 32, to generate a voltage whose amplitude is representative of the distance between a feeder 10 and a hopper 30. In an arrangement in which only one feeder is being controlled, the control panel 40″ is provided with an off/on switch and a control knob 40*b*″ for developing a code representative of the desired product size which is shown in display 40*a*″. The output, which may be digital, is applied to a digital-to-analog converter 62. The signal from proximity switch 60 is applied to a pair of comparators 64*a*, 64*b*. One of the comparators determines when the signal is greater than the output of the proximity switch 60 while the other comparator determines when the control signal is less than the output of the proximity switch. The output signal from proximity switch 60 is also converted in A-to-D converter 68 where it is compared against the digital output of the control signal. The difference signal developed by circuit 70 is applied to actuator controller 66 which provides appropriate signals for the direction and distance through which the linear actuator 48 is to be moved. Actuator 48 may be provided with a potentiometer for generating an output signal whose value is representative of the position of the actuator. This is compared with the output signal of the actuator controller by a difference circuit 70 to turn off the actuator controller 66.

Circuitry of the type shown in dotted rectangle 72 may be provided within each feeder 10. Thus, by adjusting the control knob 40*b*″, all of the feeders coupled thereto may be simultaneously adjusted to any one of an infinite number of positions between the minimum and maximum product size limits.

Considering FIG. 1, the signatures delivered to hopper 30 are preferably controlled to prevent the quantity of signatures delivered thereto from exceeding a predetermined limit. This is accomplished by utilizing a photoelectric device 76 which senses a reflective element 78 provided near the upper end of the right-hand wall 30*a* of hopper 30. When the signatures collected in hopper 30 reach a predetermined height, they cover reflective element 78 causing a change in the output of sensor 76 which condition is detected to automatically turn off the conveyors belts in each of the sections 18, 20 and 22 of feeder 10. The conveyor belts are not turned on until the level of signatures in hopper 30 falls sufficiently to expose reflective element 78. This condition is sensed by sensor 76 causing the conveyor belt motors to be reenergized.

Figure 3:
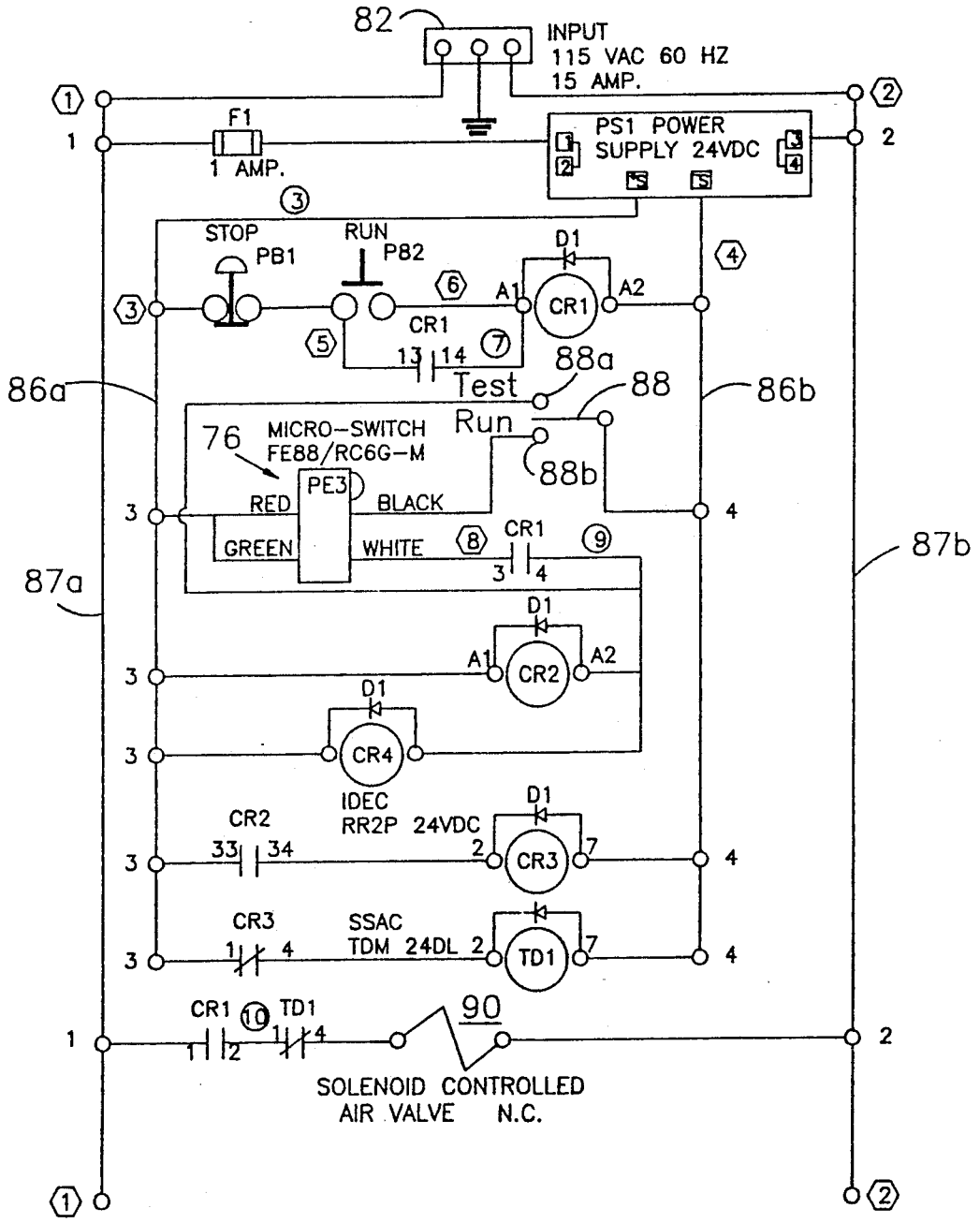
FIGS. 3 and 3*a* are schematic diagrams showing air blast control and jogger motor control circuits for use in the feeder of FIG. 1.

Feeder 10 is further provided with an air blast device 80 which directs a blast of air toward the top of the signatures S as they make the transition from the horizontal conveyor section 18 to the inclined or ramp conveyor section 20. The air blast serves to urge the signatures downwardly against the ramp conveyor belt and further serves to separate the signatures from one another. FIG. 3 shows an electrical circuit provided within the feeder 10 for automatically turning off air blast device 80 after a predetermined delay.

FIG. 3 shows an electrical circuit in which an AC input 82 is applied to a power supply 84 coupled between AC lines 87*a*, 87*b* for converting 115 volt AC to a 24 volt DC power supply. Fuse F1 protects the power supply. The 24 volt DC output is coupled across lines 86*a*, 86*b*. A run switch PB2 is closed when the feeder is turned on energizing relay CR1 and closing its normally-open contacts CR1-1 and CR1-2 and CR1-3. Contacts CR1-1 maintain relay CR1 energized so long as the stop button PB1 is not operated. Contact CR1-2 enables an electrical circuit for energization of relay CR2 when contact arm 88 engages stationary contact 88*b*.

A toggle switch having a switch arm 88 and stationary contacts 88*a* and 88*b* is switchable between a test or bypass state and a run state being respectively coupled to stationary contacts 88*a* and 88*b* for these operating states. During a test or bypass operation, switch arm 88 engages contact 88*a* completing an electrical circuit for relay CR2 which closes contacts CR2-1 thereby energizing relay CR3. The closure of relay CR3 opens normally-closed contacts CR3-1 turning off time delay relay TD1 which substantially immediately causes contacts TD1-1 to close and remain closed. The time delay relay TD1 is a settable time delay relay having a plurality of DIP switches (not shown) for adjusting the time delay to any suitable time interval, for example, one second. Upon energization of time delay relay TD1, normally-closed contacts TD1-1 open one second after energization of TD1 to turn off solenoid-controlled air valve 90. This test or bypass mode may be utilized for testing relay TD1 as well as confirming its proper operation.

In the run mode, switch arm 88 engages stationary contact 88*b* providing electrical power to microswitch 76 which is identified as the light sensing element 76 shown in FIG. 1. So long as the reflective element 78 (see FIG. 1) is not covered by signatures, microswitch 76 establishes a closed circuit in series with relay contact CR1-2 causing relay CR2 to be energized and closing its contacts CR2-1 which energizes relay CR3 to open normally-closed contact CR3-1 thereby deenergizing time delay relay TD1 and maintaining its normally-closed contacts TD1-1 closed. Since contacts CR1-3 are closed, solenoid-controlled air valve 90 is maintained energized during normal operation.

When reflective element 78 is covered with signatures, microswitch 76 establishes an open circuit which, even though relay contacts CR1-2 are closed, causes deenergization of relay CR2 which causes contacts CR2-1 to open deenergizing relay CR3. The deenergization of relay CR3 closes contacts CR3-1 energizing relay TD1. The energization of relay TD1 opens its normally-closed contacts TD1-1 one second after deenergization (for example) thus turning off the solenoid-controlled air valve 90 to save energy as well as preventing the generation of an air bast when signatures are not moving along the conveyor. One of the relays CR2 or CR3, not shown for purposes of simplicity, may cause immediate turn off of the conveyor belts in the conveyor sections 18, 20 and 22.

Figure 3A:
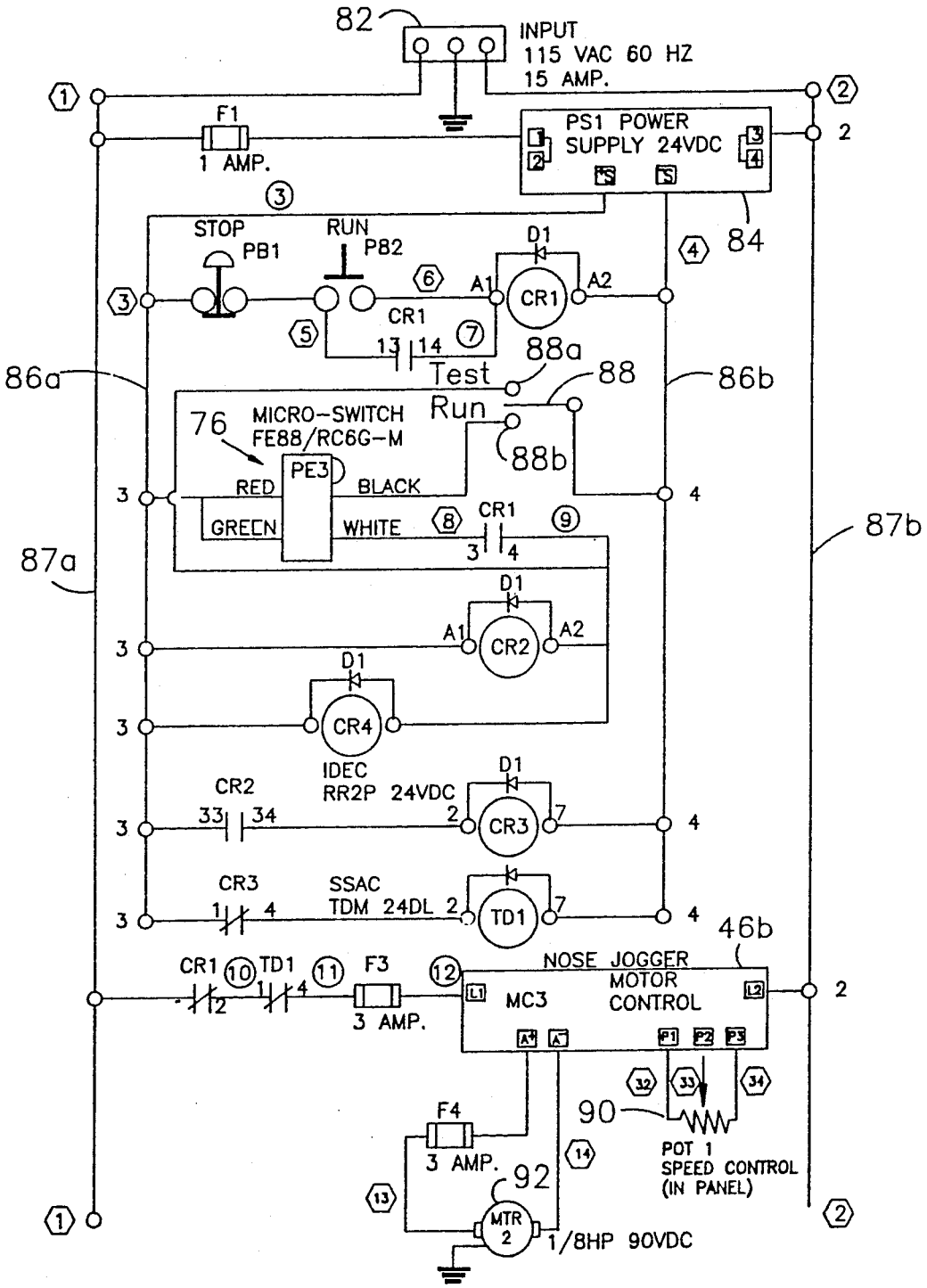

In a similar manner the circuit of FIG. 3*a* operates nose jogger motor control circuit 46*b* as follows:

During the test mode, switch arm 88 engages stationary contact 88*a* energizing relay CR2 which closes contact CR2-1 thereby energizing relay CR3. The energization of relay CR3 opens its normally-closed contacts CR3-1 deenergizing time delay relay TD1 causing its normally-closed contacts TD1-1 to close rapidly and remain closed. The closure of contacts CR1-3 upon energization of relay CR1 provides AC power to the nose jogger motor control 46*b*.

In the run state, switch arm 88 engages contact 88*b* energizing microswitch 76. When the reflector element 78 is uncovered (FIG. 1), an electrical path is completed through microswitch 76 and relay contact CR1-2, energizing relay CR2 and closing its contact CR2-1 thereby energizing relay CR3 to open its normally closed contact CR3-1 thus maintaining time delay relay TD1 deenergized. The normally-closed contacts TD1-1 of time delay relay TD1 remain closed and cooperate with the previous closure of relay contact CR1-3 to provide electrical energy to motor control 46*b*. When the reflector element 78 is covered, sensor 76 opens the electrical circuit previously completed with contacts CR1-2 thereby deenergizing relay CR2 and opening its contacts CR2-1 which deenergizes relay CR3 returning its contacts CR3-1 to the closed condition. This closure energizes time delay relay TD1 which, after a predetermined delay (settable by DIP switches provided as part of relay TD1—not shown) contacts TD1-1 open after the predetermined time delay, for example, one second, turning off nose jogger motor control 46*b*. One of the relays CR2 or CR3 may be used to immediately turn off the conveyor sections 18, 20 and 22.

The circuits of FIGS. 3 and 3*a* continually switch from one state to the next (i.e. "on" to "off" to "on") as the hopper 30 alternates its condition between being filled to capacity with signatures and having the signature level fall below reflector 78. In each case the deenergization of the time delay relays in FIGS. 3 and 3*a* cause substantially immediate closure of the normally-closed contacts for respectively energizing the solenoid 90 and the motor control 46*b* while providing a presettable time delay for turn off of solenoid 90 and jogger motor control circuit 46*b*. The circuits of FIGS. 3 and 3*a* are both used in systems incorporating a jogger and an air blast device.

Figures 4A, 4B:
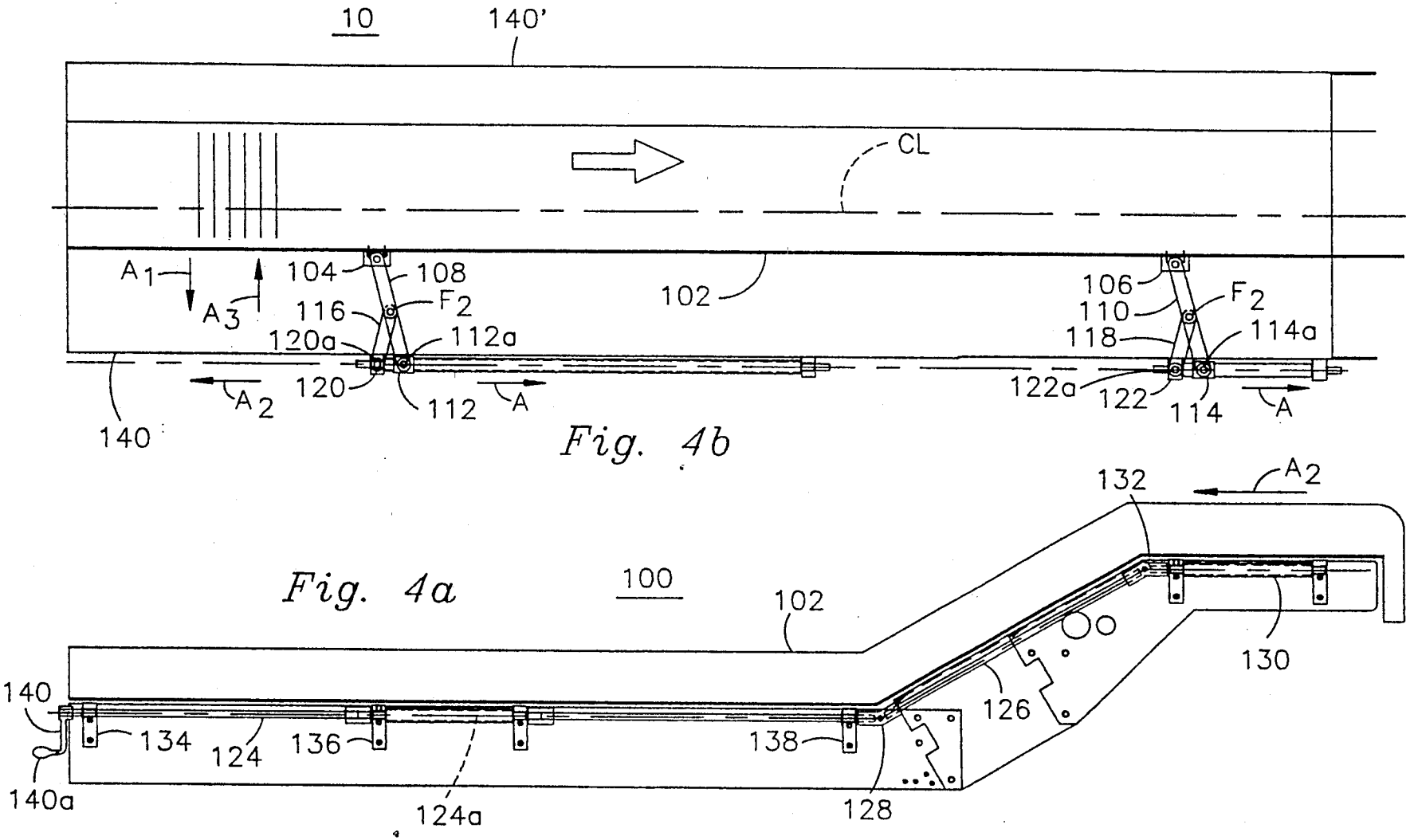
FIGS. 4*a* and 4*b* show side elevation and top plan views respectively of side guide assemblies employed in the feeder of FIG. 1.
Figure 4C:
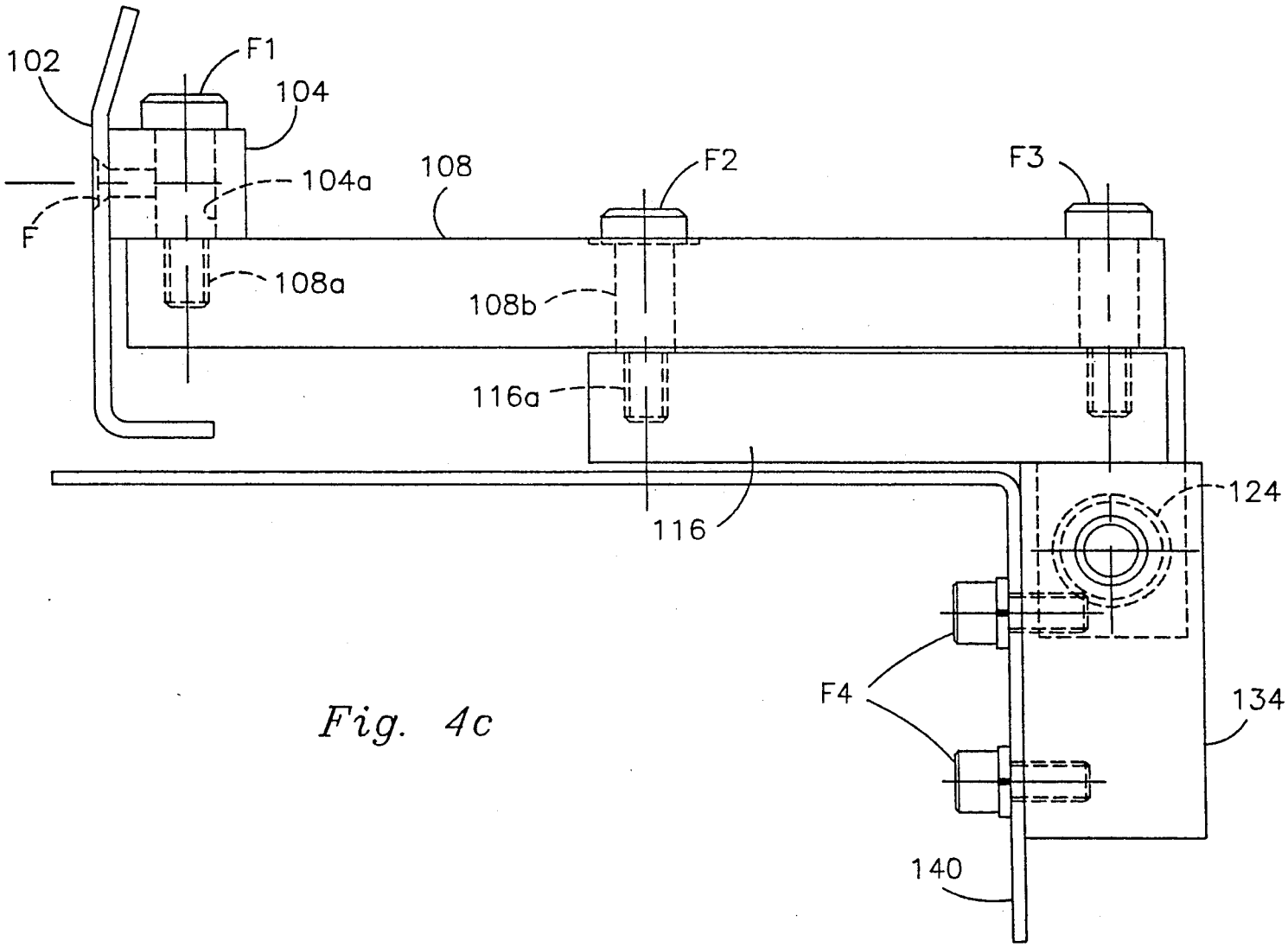
FIG. 4*c* shows an enlarged end view of the linkage assemblies employed in the side guides of FIGS. 4*a* and 4*b;*

FIGS. 4*a*, 4*b* and 4*c* respectively show the side elevation, top plan view and end view of the novel side guide assembly utilized in the feeder 10.

The preferred embodiment of the side guide assembly 100 is comprised of a one-piece side guide 102 of a shape conforming to the shape of the sections 18, 20 and 22. A pair of supporting blocks 104 and 106 are directly secured to side guide 102 by suitable fastening means F. A linkage arm 108, 110 is pivotally coupled to an associated one of the mounting blocks 104, 106 by a fastener F1 which threadedly engages each of the arms 108, 110 while extending through a clearance opening in each block 104 and 106. The clearance opening 104*a* is shown for block 104 in FIG. 4*c*.

The opposite end of each of the arms 108, 110 is pivotally coupled to threaded nuts 112, 114 by pin means 112*a*, 114*a*.

The intermediate portion of each arm 108, 110 is pivotally coupled to a short arm 116, 118 by means of a fastener F2 extending through a clearance opening in each arm 108 and 110 and threadedly engaging a tapped aperture in each of the arms 116 and 118. FIG. 4*c* shows fastener F2 extending through a clearance opening 108*b* in arm 108 and threadedly engaging an opening in arm 116. The opposite ends of each of the arms 116, 118 is pivotally coupled to a block 120, 122 by suitable pin means 120*a*, 122*a* respectively. Blocks 120 and 122 are fixedly secured to support frame 140. An elongated threaded assembly is comprised of a first elongated threaded member 124, a second shorter threaded member 126 coupled to member 124 by universal joint 128, and a final threaded member 130 coupled to the end of threaded member 126 by universal joint 132. Threaded member 124 is rotatably mounted, i.e. is mounted to rotate about its longitudinal axis represented by dotted line 124*a* by means of clamps 134, 136 and 138 fixedly secured to side wall 140 of the feeder 10 by fasteners F4 (see FIG. 4*c*). The threaded sections 124 and 130 also extend through clearance openings in blocks 120 and 122.

Members 112 and 114 are provided with tapped openings which threadedly engage threaded members 124 and 130, respectively.

An operating handle comprised of hand crank 140 is fixedly secured to the left-hand end of threaded member 124 and a rotatable handle portion 140*a* is utilized to rotate threaded members 124, 126 and 130. The operation of adjustable side guide is as follows:

By rotating operating handle 140 in a first direction, threaded blocks 112 and 114 are caused to move in the direction shown by arrow A causing members 108 and 110 to rotate counterclockwise about fasteners F2 thereby moving one-piece adjustable side guide 102 in a direction shown by arrow Al. Rotating the hand crank in the opposite direction causes threaded members 112 and 114 to move in the directions shown by arrows A2 causing arms 108 and 110 to rotate clockwise about pivots F2 thereby moving side guide 102 in a direction shown by arrow A3.

In applications wherein the centerline of the machine represented by dotted line CL is utilized for product registry of the feeder and cooperating hopper, a similar side guide assembly may be utilized along the opposite side 140' of the feeder 10. However, if side 140' of the feeder 10 serves as the product registry, a fixed guide may be employed along side 140'. It can thus be seen that the side guide (or guides) may be adjusted through operation of a single operating handle to both fine-tune the alignment of the signatures relative to the receiving hopper as well as adjusting the side guides when undertaking a product run requiring a change in product size.

Returning again to FIG. 1, there is shown therein an adjustable angle hand-feed frame assembly 150 comprised of a driven hand-feed belt assembly 152 having pulleys 154, 156 arranged at opposite ends thereof on a suitable supporting frame enabling the belt assembly to be moved between a horizontal dotted line position 152' to an inclined angular position 152 shown in solid line fashion with the angle of the inclination being adjustable by means of an adjustable assembly also shown in FIGS. 1*e* and 1*f*.

The horizontal orientation 152' of the feed belt assembly is used when automatic feeding is utilized, i.e. when signatures are delivered to feeder 10 by a conveyor placed against the left-hand end thereof. Conveyor section 152 is coupled to the next adjacent conveyor section by suitable coupling means to operate at the desired linear speed.

When signatures are to be delivered to feeder 10 by hand, the left hand or input end of the hand-feed belt section 152 is elevated as shown in solid line fashion. A large number of products, typically of a linear length of two feet or so, may be loaded upon the hand-feed belt section. This large buffer storage of signatures enables the operator to feed multiple loaders. The angle of incline enables the products to stand up without the need for exerting extreme care in the hand-delivery of signatures thereto. Because the signatures are driven down along the hand-feed belt section, the operator does not have to worry about achieving an extremely neat pile in the hand-feed section. The storage of approximately two feet of signatures enables the operator to walk away from the feeder and feed other adjacent feeders.

In addition, the adjustability of the angle of inclination of the adjustable feed assembly 150 enables the section to be accommodated to the height of the particular operator resulting in a significant reduction in operator fatigue.

FIGS. 1*e* and 1*f* show detailed views of the adjustment assembly forming part of the adjustable angle hand-feed frame assembly 150, the adjustment assembly comprising a rod 160 freely rotatable within a pair of end blocks 162*a*, 162*b* forming a part of the feeder frame assembly supporting the horizontal conveyor. A block 164 is secured to rod 160 at a point intermediate the ends thereof and has an elongated threaded rod 166 extending upwardly therefrom. Rod 166 has an adjuster knob 168 with a threaded opening which threadedly engages threaded rod 166. A locking knob 170 also threadedly engages rod 166. Rod 166 extends through a central opening 172*a* in a bar 172 coupled at its opposite ends to a pair of frame members 174*a*, 174*b* forming part of the driven hand-feed belt assembly 152. Opening 172*a* is a clearance opening having an ID which is greater than the OD of threaded member 166.

The manner in which the assembly 150 is adjusted for hand-feed operation is as follows:

In order to convert from automatic feed to manual feed, belt assembly 152 is lifted at its left-hand end causing it to rotate clockwise about the centerline for pulley 156. Adjuster knob 168 is rotated in a direction causing it to move upwardly toward bar 172 as shown by arrow 176. When the proper height is obtained, tightening knob 170 is rotated to firmly engage adjuster knob 168 in order to prevent the adjuster knob 168 from loosening. The weight of assembly 152 bears upon adjuster knob 168 by way of bar 172 maintaining the hand-feed belt assembly 150 in the proper position.

In order to reduce the angle of inclination, or alternatively, to return the driven hand-feed belt assembly 152 to horizontal orientation, locking knob 170 and adjuster knob 168 are successively rotated in a direction opposite that shown by arrow 176 to lower these knobs downwardly toward rod 160 to a point which either reduces the angle of inclination of assembly 152 or returns the assembly to the horizontal orientation.

Although the rod or shaft 160 is shown as being rotatable within members 162*a* and 162*b* with block 164 fixedly secured to rod 160, rod 160 may be fixedly secured to mounting blocks 162*a* and 162*b* and block 164 may be rotatably mounted upon shaft 160. To prevent block 164 from sliding along rod 160, collars 178*a*, 178*b* are provided along rod 160, which collars are provided, for example, with set screws to fixedly secure the collars to rod 160 and thereby act as stops preventing member 164 from moving linearly along the direction of the longitudinal axis of rod 160.

Figure 5:
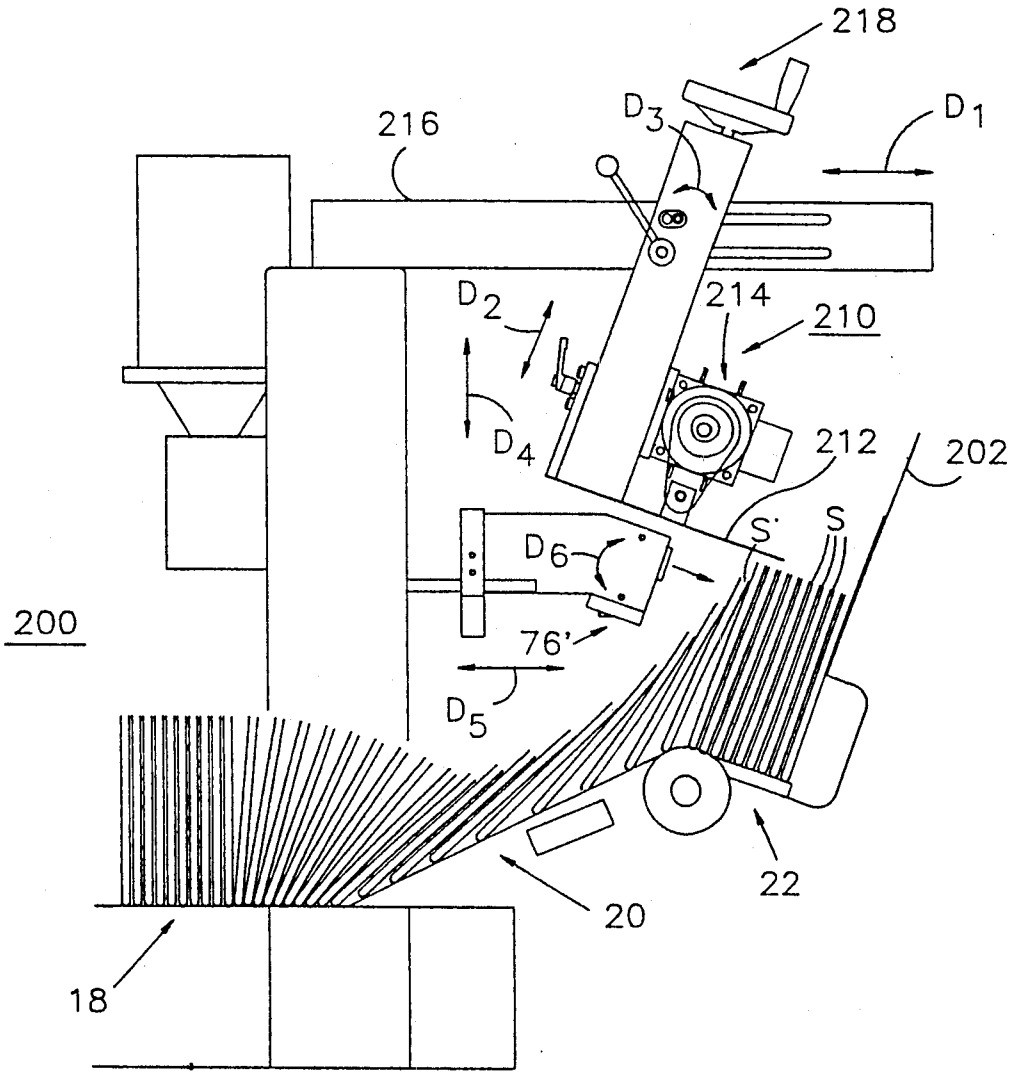
FIG. 5 shows a schematic elevational view of another embodiment of the feeder assembly of the present invention.

FIG. 5 shows another alternative feeder embodiment 200, a portion of which has been shown in schematic (i.e. simplified) fashion. The feeder shown therein is comprised of a horizontal conveyor section 18, a ramp conveyor section 20, and a generally downwardly inclined feeder section 22 which feeds signatures S so that their orientation is as shown at conveyor section 22 with the major faces thereof being aligned at an angle of about 30 degrees with the vertical, the right-handmost signature resting against a back plate 202. In order that the signatures be uniformly fed in an error free manner from the conveyor section 22, it is important that the signatures collected on conveyor section 22 be neatly arranged. To facilitate this a beaver-tail jogger assembly 210 is provided. The beaver-tail jogger assembly includes a paddle 212 which is reciprocated at a high rate of speed by a motor 242 operating in a manner to be more fully described. The beaver-tail assembly is adjustable in two mutually perpendicular linear directions as shown by arrows D1 and D2 and is angularly adjustable as shown by arrows D3 in order to orient the jogger paddle 212 at the proper angle as well as adjusting the jogger paddle at the proper height relative to the signatures being collected upon conveyor section 22.

The feeder 200 is turned on and off under the control of a sensor 76' similar to the sensor 76 in that it selectively controls the turn on and turn off of conveyor sections 18, 20 and 22 but differing from sensor 76 in that sensor 76' is a proximity or distance measuring sensor which is adjusted to control the amount of signatures collected upon conveyor section 22. For example, when the position of the signature S' shown in FIG. 5 moves closer to proximity sensor 76', the sensor will turn off conveyor sections 18, 20 and 22. However, as soon as the signatures collected upon conveyor section 22 are fed to an output utilization device such as a saddle feeder (not shown for purposes of simplicity), then the distance between sensor 76' and signature S' increases whereupon conveyor sections 18, 20 and 22 are turned on. Similar to the beaver-tail jogger assembly 210, photosensor 76' may be adjusted in two mutually perpendicular directions as shown by arrows D4 and D5 and in an angular direction as shown by arrows D6. The first adjustment in the horizontal direction moves the sensor away from the feedrack for an increased depth of paper in the feedrack or moves toward the feedrack for a decrease in paper depth. The second adjustment raises and lowers the sensor for varying signature widths. The third adjustment changes the angular position of the sensor.

Figure 5A:
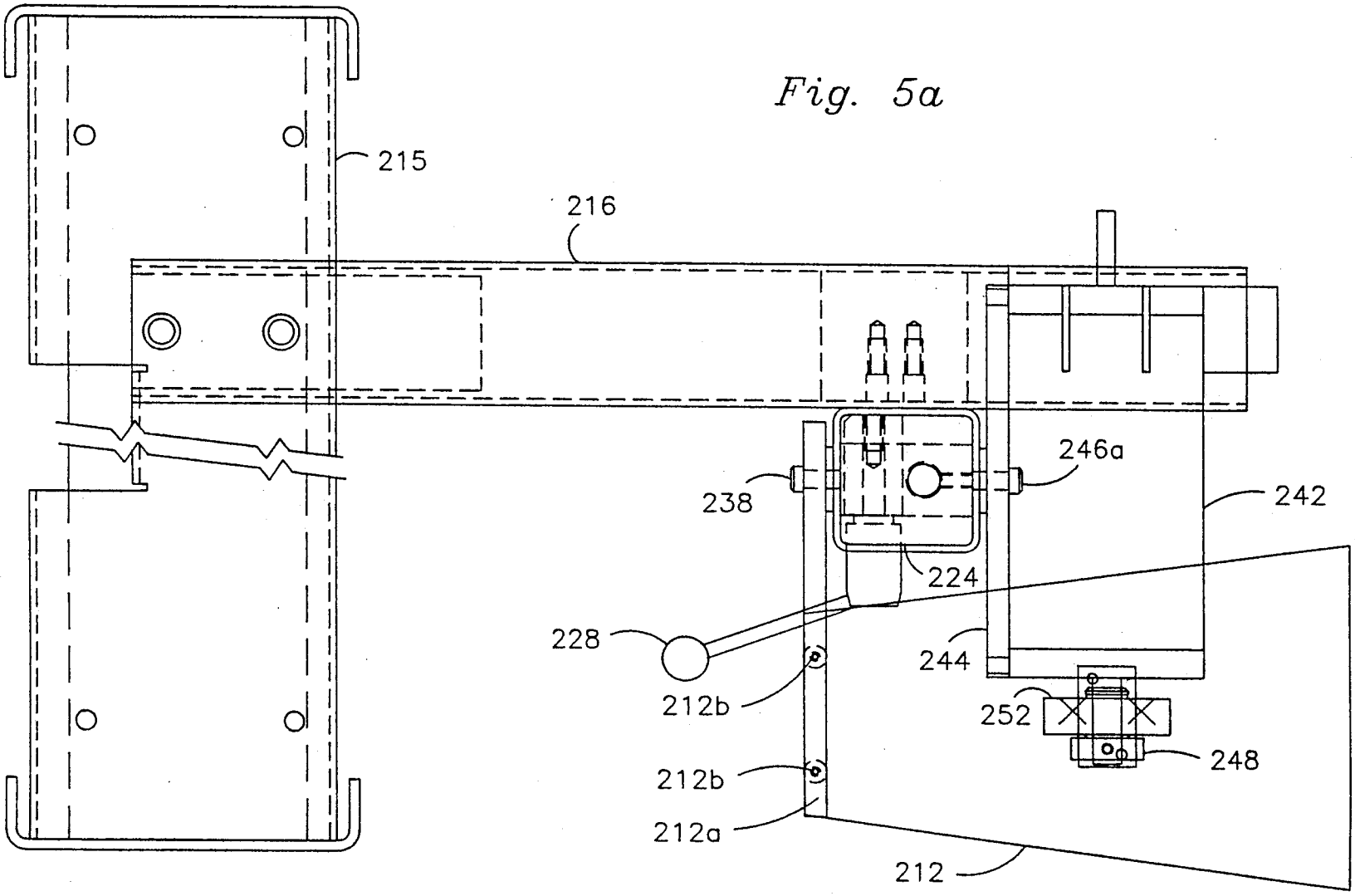
FIGS. 5*a*, 5*b* and 5*c* are top plan, side elevation and end elevation views respectively of a beaver-tail jogger and adjustment assembly for use in the feeder of FIG. 5.
Figure 5B:
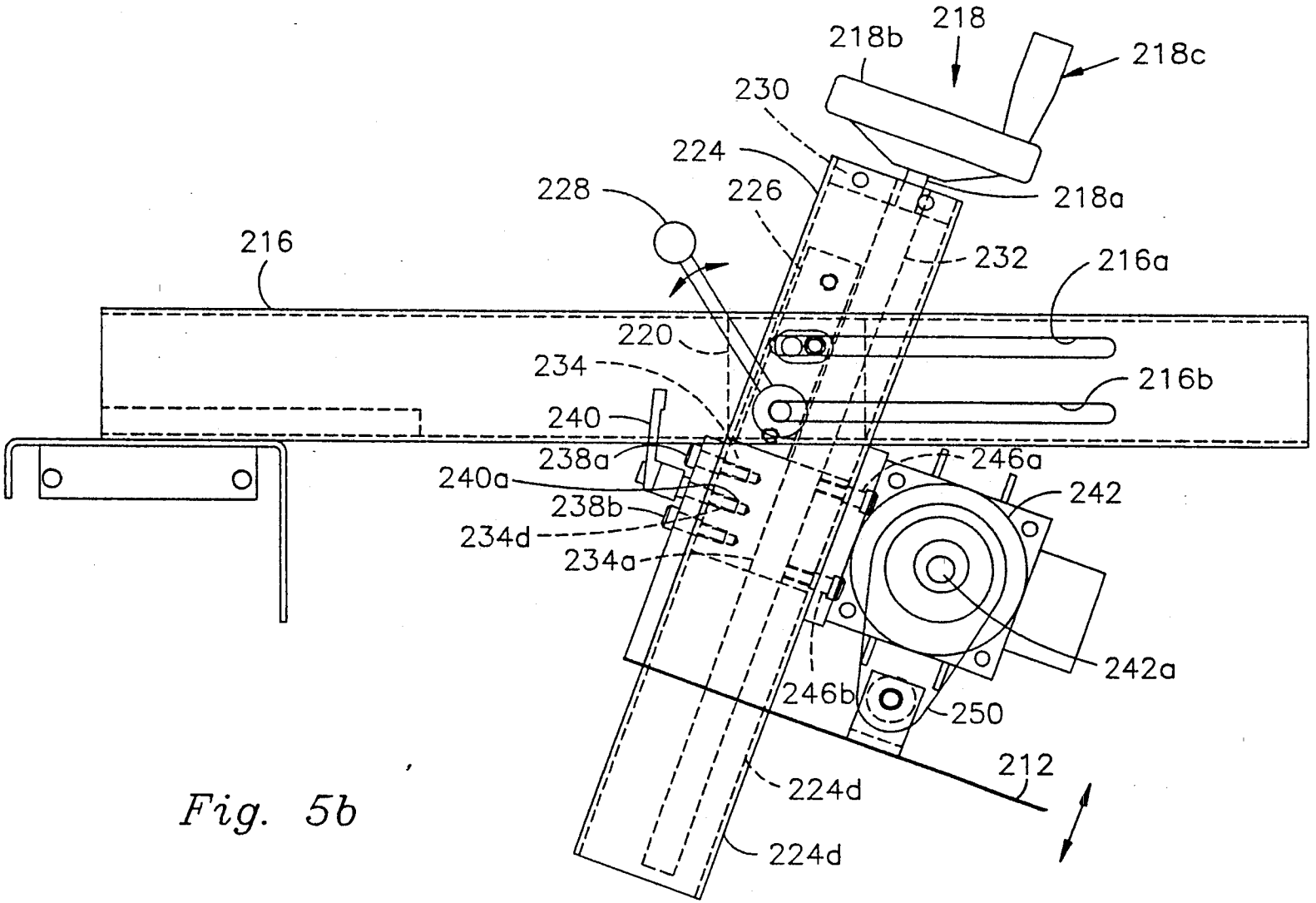
Figure 5C:
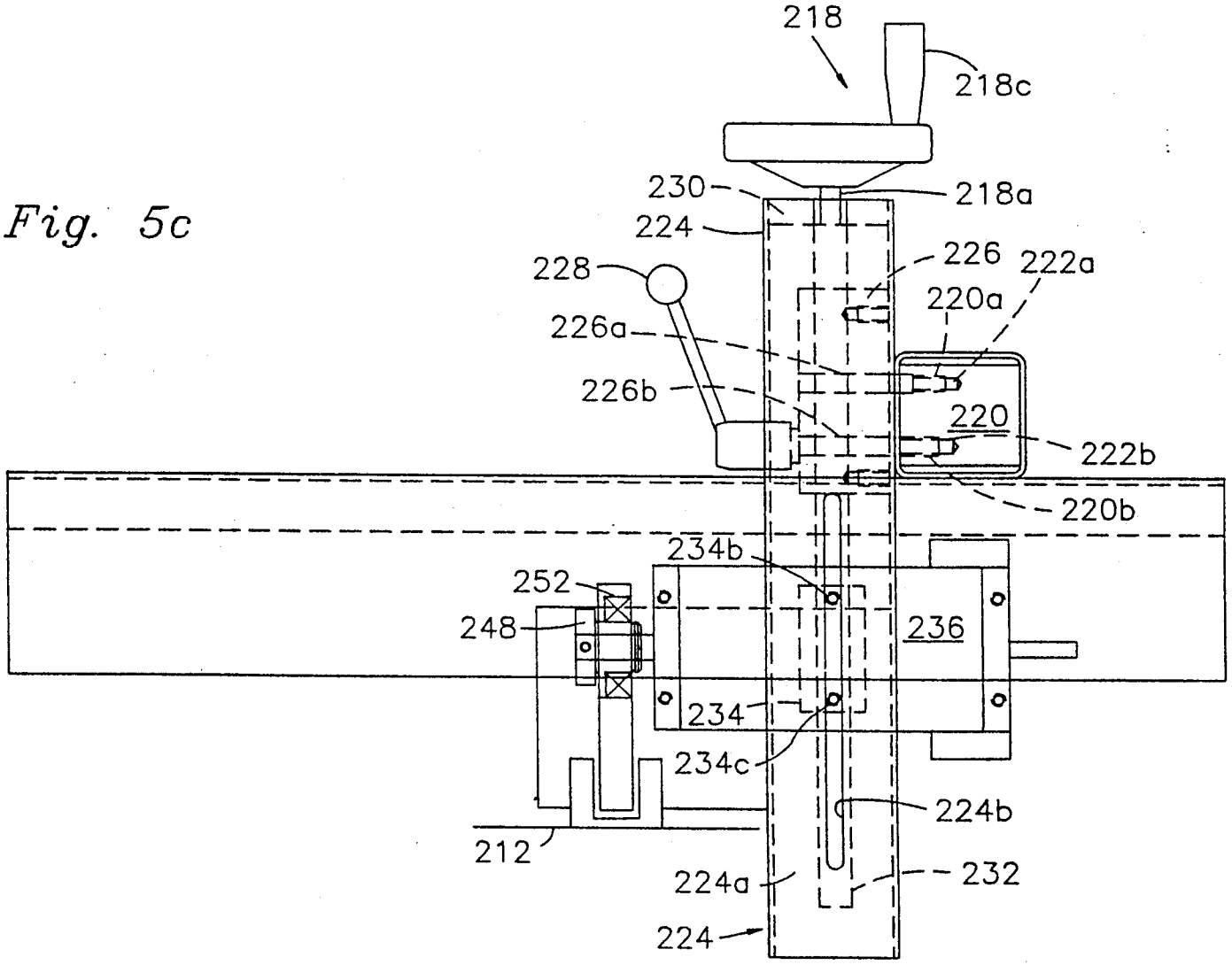

FIGS. 5*a*, 5*b* and 5*c* show top, side and end elevational views respectively of beaver-tail jogger assembly 210. FIG. 5*a* shows the assembly 210 with the operating handle 218 removed.

Frame member 216, mounted to support 215, is preferably a hollow tube of substantially rectangular cross-section and is provided with a pair of elongated slots 216*a*, 216*b*. A horizontal adjustment block 220 is slidably mounted within rectangular-shaped tube 216. A pair of threaded bolts 222*a*, 222*b* threadedly engage top openings 220*a* and 220*b* within slidable block 220.

An elongated, hollow tube 224 of substantially rectangular cross-section is secured to tube 216 in a manner to be more fully described and supports jogger paddle 212 and motor 242. An elongated rectangular-shaped block 226 is mounted within tube 224. Fastening member 220*a* is secured to block 224 and extends into opening 220*a* in block 220. Threaded member 222*b* extends through a clearance opening 226*b* in block 226 and has its left-hand end coupled to an operating handle 228. By turning the handle 228 in a first direction, the threaded right-hand end of fastener 222*b* threadedly engages the tapped opening 220*b* pressing and clamping block 226 and tube 224 firmly against tube 216 to retain the tube 224 in any position within the range of the slots 216*a* and 216*b* to thereby move the beaver-tail jogger assembly either closer to or further away from the end wall 202.

An end cap block 230 is fixedly secured within the upper end of tube 224 to provide a bearing bushing for the stub shaft portion 218*a* of handle assembly 218 which comprises a substantially circular-shaped member 218*b* joined to the upper end of stub shaft 218*a* (relative to FIG. 5*b*) as well as a hand wheel 218*c*.

The lower end of stub shaft 218*a* is integrally joined to an elongated threaded shaft 232 which threadedly engages and extends through and beyond the tapped opening 234*a* in a vertical adjustment block 234. The hand wheel assembly 218 is rotatably mounted within a suitable bearing bushing in end cap 230 so that threaded shaft 232, although rotatable about its longitudinal axis, experiences no linear movement relative to tube 224.

Side 224*a* of tube 224 is provided with an elongated slot 224*b*. A rectangular-shaped plate 236 is secured to vertical adjustment block 234 by a pair of threaded fasteners 238*a*, 238*b* which extend through suitable openings in plate 236 and threadedly engage tapped apertures 234*b*, 234*c* in vertical adjustment block 234 to firmly secure plate 236 to block 234, while permitting block 234 and plate 236 to slide relative to tube 224. An adjustment handle 240 having an integral threaded portion 240*a* threadedly engages a tapped aperature 234*d* in vertical adjustment block 234 for clamping tube 224 between block 234 and plate 236 for securing a desired vertical position in a manner to be more fully described.

Motor 242 is secured to a motor mount 244 which in turn is secured to vertical adjustment block 234 by means of a pair of fasteners 246*a*, 246*b* extending through an elongated slot 224*d* provided in side surface 224*e* of tube 224 which is parallel to side surface 224*a*, the elongated slot 224*d* being slightly greater in length than the slot 224*b*.

The motor 242 is provided with an eccentric bushing 248. A linkage arm 250 is rotatably mounted to the eccentric bushing by thrust bearing 252. The eccentric bushing 248 converts the rotation of motor output shaft 242*a* to a substantially linear reciprocating motion which is imparted to jogger paddle 212 whose left-hand end relative to FIG. 5*a* is secured to the jogger paddle mounting bracket 212*a* by suitable fastening means 212*b*.

The manner of operation of the beaver-tail jogger assembly and the adjustment thereof is as follows:

In order to adjust the position of tube 224 relative to tube 216, operating handle 228 is rotated counterclockwise, for example, to loosen tube 224 relative to tube 216. Tube 224 may then be moved either toward the right or toward the left within the end limits of slots 216*a*, 216*b*. Upon appropriate positioning thereof, handle 228*a* is rotated clockwise, for example, to rigidly secure tube 224 to tube 216 by clamping blocks 226 and 220 and hence tubes 216 and 222.

A fine-tuned vertical adjustment is obtained by loosening operating handle 240 and then operating hand wheel assembly 218 causing block 234 to move either upwardly or downwardly within tube 224 depending upon the direction of rotation of hand wheel assembly 218. When the proper position is obtained, handle 240 is tightened to maintain the fine-tuned position. The block 234 is drawn toward plate 236 which clamps side 224*a* of tube 224 therebetween rigidly securing the motor 242 and jogger paddle 212 at the desired orientation relative to the stack of signatures collected on conveyor section 22. The rotational output of motor 242 is converted to reciprocating motion, which is imparted to paddle 212, by means of the eccentric bushing and link arm 248 and 250, respectively. The fine-tuning of the jogger paddle 212 due to the "micro" adjustment system produces a neater pile in the hopper feedrack. The tendency for the operator to overadjustment the jogger such that too great a pressure is imposed on the jogger is also reduced. In addition, overloading the jogger can damage the signatures and can also cause permanent damage to the jogger assembly. The simplicity of the adjustment assembly facilitates jogger fine-tuning. The pitch of the threaded rod is also selected to facilitate the "micro" adjustment capability.

Figure 6:
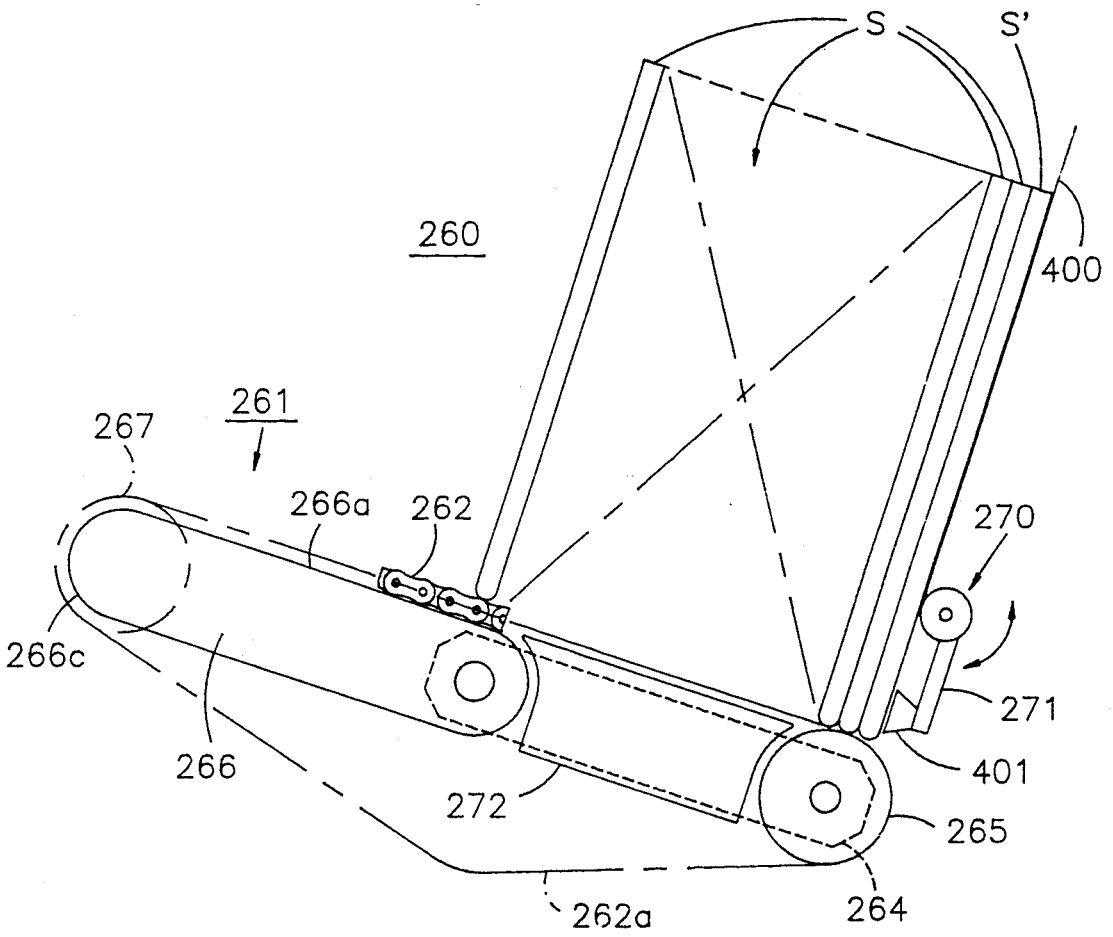
FIG. 6 shows a schematic side elevational view of a novel feedrack assembly for use in coupling with the feeders of the type shown, for example, in FIG. 5.

The feeder of the present invention may be utilized with a variety of different output utilization devices such as, for example, a saddle hopper feedrack. FIG. 6 shows a saddle hopper feedrack 260 designed in accordance with the principles of the present invention, which comprises a chain drive assembly for advancing signatures as they are removed from the feedrack for delivery to a saddle stitcher (not shown for purposes of simplicity). The feedrack comprises a pair of drive chains 262, only one of which is shown in FIG. 6 for purposes of simplicity, it being understood that each drive chain is similar in design and function. Chain 262 is entrained about a drive sprocket 265 and guide edges of link 266 and plate 272 as will be more fully described. When operated in the manual loading mode, signatures are loaded onto the drive chains 262 by hand and are arranged in the manner shown. The signatures are diagonally aligned in the manner shown and the right-hand-most signature S' rests against a stop 400. A take-off assembly 270 comprising a rotatably mounted arm 271 carrying a suction member 401 draws the right-hand-most signature S' away from the stack. As each signature is drawn from the stack, a feed pawl, to be more fully described in connection with FIGS. 6*a*–6*c*, operates to move the chains 262 through a distance substantially exactly equal to the thickness of one signature, i.e. the signature removed from the stack.

In applications wherein it is desirable to provide automatic feeding of signatures to the assembly 260, present day technology necessitates that the feedrack, including the drive chain 262 and its drive sprockets be removed from the saddle stitcher for installation of a feeder of the type shown, for example, in FIG. 5. This has proven to be a significant problem when the feeder is installed. The feedrack assembly shown in FIG. 6 requires readjustment for proper hopper performance which is a labor-intensive, time-consuming procedure requiring a high degree of expertise.

The design of the present invention provides a novel feedrack which is capable of pivoting in the center to allow a very simple installation of the feeder thereto. The conventional hopper feedrack cannot be used with the feeder for the reason that when the loader is interfaced with a conventional rack, the signature pile which is presented to the hopper is too large, i.e. contains too many signatures, causing too much pressure to be applied to the hopper which significantly degrades the desirable error-free operation.

Figure 6B:
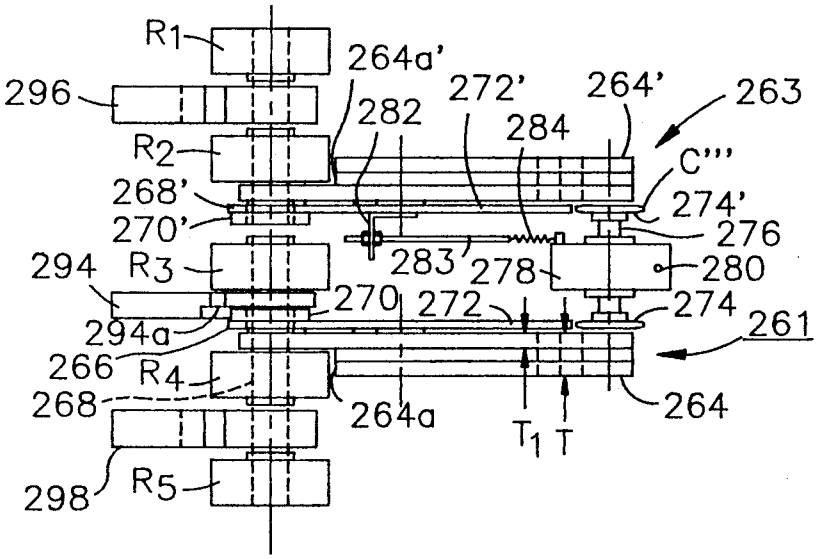
FIGS. 6*a*, 6*b* and 6*c* show top plan, top plan and side elevational views respectively of the novel collapsible feedrack assembly of FIG. 6.

The novel hopper feedrack 260 of the present invention comprises a pair of link assemblies each assembly in turn comprised of first and second links 264, 266 which are pivotally connected to one another. Noting, for example, FIGS. 6 and 6*a*–6*c*, the novel linkage assembly of the present invention is comprised of first and second linkage assemblies 261, 263 which can be seen in FIG. 6*b* to be mirror images of one another. The like elements of assemblies 263 are designated by primes. The assembly 261 is shown in FIGS. 6*b* and 6*c* as comprising links 264 and 266 pivotally joined to one another by means of shaft 268. Link 266 is a substantially flat plate of uniform thickness and is maintained secured to link 264 by means of clamp 270. Link 264 has a uniform thickness T which extends from its right-hand end relative to FIG. 6*b* to substantially three-quarters of its entire length whereupon it has a reduced thickness T1 which is substantially uniform over the remaining one-quarter of its length forming a cut-out portion 264*a* which provides clearance for one of the feeder rollers R of the feeder, when the feedrack is aligned with a feeder 10 as will be more fully described in connection with FIGS. 6*a* and 6*c*. A chain guide plate 272 having curved left and right-hand ends 272*a*, 272*b* respectively is fixedly secured by suitable fastening members to link 264. Curved portion 272*b* provides clearance for sprocket 274 and curved portion 272*a* provides clearance for the rounded end 266*b* of link 266. The guide edge 272*c* is aligned with sprocket 265 and the guide edges of link 266. Chain 262 slides along and is guided by the upper edge 272*c* of chain guide plate 272 and further slides along the top guide edge 266*a* of link 266 and the rounded left-hand end 266*c*, as shown best in FIGS. 6 and 6*c*. Considering FIG. 6, it can be seen that the chain 262 is not maintained taut about sprocket 265 and the guide plates 272, 266 but droops downwardly somewhat as shown by its lower run 262*a*.

Sprockets 274 and 274' are rotatably mounted to links 264 and 264' (see FIG. 6*b*) and a shaft 276 common to sprockets 274, 274' mounts a feed pawl 278 which is advanced by a conventional mechanism to rotate sprockets 274, 274' through an angle sufficient to advance the upper runs of the chains entrained thereabout through a linear distance sufficient to advance the signatures remaining on the hopper feedrack through a distance equivalent to one signature thickness.

A bracket 282 is fixedly secured to chain guide member 272' and has an axially adjustable pin 283 whose right-hand end is coupled to one end of a bias spring 284, the opposite end of which is coupled to feed pawl 278.

Figure 6A:
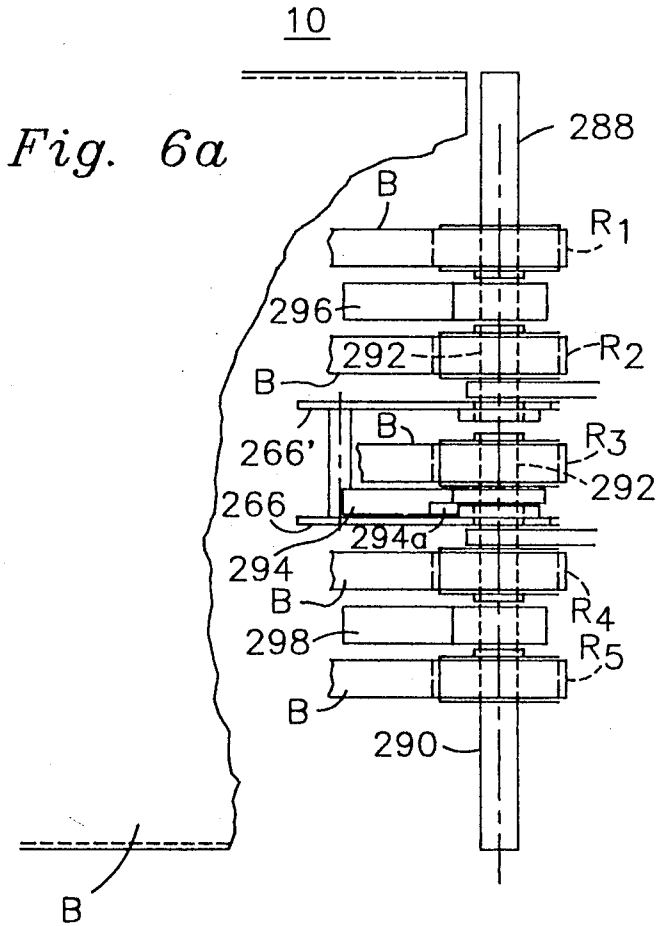
Figure 6C:
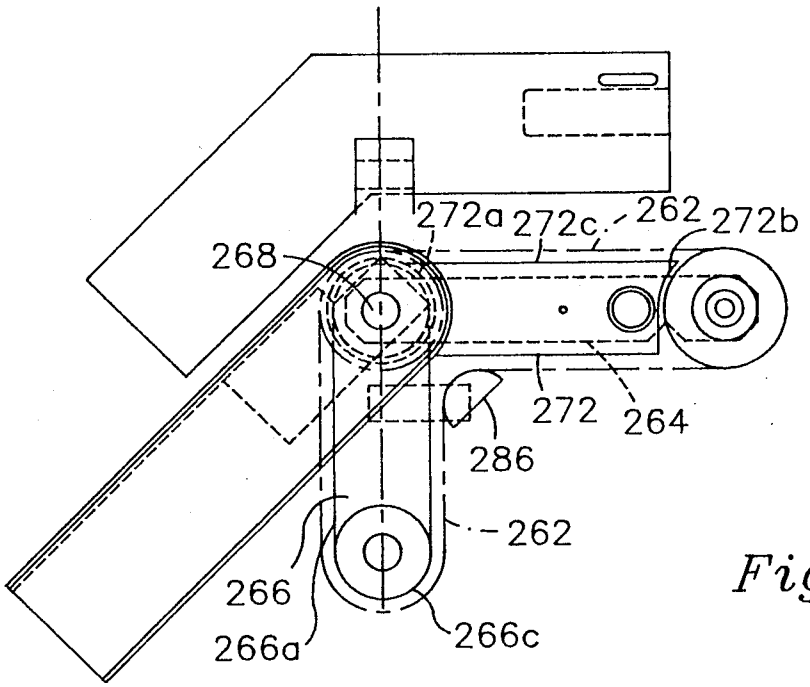

In the embodiments shown in FIGS. 6*a*–6*c* to mount a feeder 10 to the feedrack, clamps 270 and 270' are loosened, causing links 266, 266' to swing downwardly and out of the way so as not to interfere with the operation of either the feedrack or the feeder. In order to take up some of the slack in chain 262, a semicircular guide member 286 is provided to cause chain 262 to assume a substantially right angle shape beneath links 264, 266, as shown in FIG. 6*c*.

As shown in FIG. 6*a*, the feeder downstream end is provided with a support surface T. Conveyor belts B are each entrained about one of a plurality of rollers R1 through R5. Rollers R1 and R2 are mounted upon a common shaft 288. Rollers R4 and R5 are mounted upon a shaft 290. Roller R3 is mounted upon a shaft 292. Sufficient clearance is provided between rollers R2 and R3 and between rollers R3 and R4 in which to insert the left-hand end of the links 264 of the feedrack.

In order to assemble the feeder to the feedrack, after the links 266 are loosened, the feeder is moved toward the feedrack and is aligned so that the assemblies 261 and 263 are positioned to enter into the gap regions between rollers R4-R3 and R3-R2, respectively. When the feeder 10 and feedrack assembly 260 are substantially in alignment, which can be accomplished by means of a conventional floor mount (not shown), any height adjustments are provided for by hand crank assemblies 12*a* provided on each of the leg assemblies of feeder 10 (see FIG. 1) so as to bring the axes of rotation of rollers R1 through R5 into colinearity with the longitudinal axis of shaft 268.

The notched portions 264*a* and 264*a'* of links 264 and 264' provide clearance for rollers R4 and R2 as shown in FIG. 6*b*. The bracket 294 supporting the shaft 292 for rotatably mounting roller R3 is likewise notched as shown at 294*a* to provide clearance for collar 270.

It should further be noted that the brackets 296 and 298 further cooperate to rotatably support shafts 288 and 290, respectively.

It can thus be seen that the novel split section feedrack of the present invention enables the feeder and the feedrack to be coupled together in a simple, rapid and yet highly accurate manner as compared with prior art techniques which require an extremely tedious and time-consuming procedure.

As another alternative to pivoting down the sections 266 and 266', it is fairly obvious that rather than pivoting down the sections 266, 266' in the manner shown in FIGS. 6*b* and 6*c*, sections 266 and 266' may be removed from their associated sections 264 and 264' when attaching the feedrack to a feeder 10.

When it is desired to operate the feedrack in the manual mode, the feeder 10 is simply moved away from the feedrack, the links 266 and 266' are moved from the position shown in FIG. 6*c* to the position shown in FIG. 6 and the clamps 270 and 270' are locked to retain the links 264, 266 and 264', 266' in the straightline arrangement shown in FIG. 6.

It can thus be seen that the novel saddle hopper feedrack assembly of the present invention greatly simplifies the coupling of the saddle stitcher to a feeder for automatic operation which set up is significantly easier and faster than the feedracks of conventional design and which further permits simple and rapid set-up of the feedrack for manual loading.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A signature feedrack assembly comprising:

chain drive means for supporting a plurality of signatures along one edge thereof;

an end wall arranged substantially at a right angle to an upper run of said chain drive means and cooperating with said chain means for supporting a stack of signatures on end;

means for removing a signature adjacent said end wall;

means responsive to removal of a signature for moving said chain drive means through a linear distance for advancing the signatures on said upper run through a distance substantially equal to a width of a signature;

said chain drive means including a drive sprocket;

a first linkage arm;

said sprocket being pivotally mounted at a first end of said first linkage arm;

a second linkage arm;

a first end of said second linkage arm being pivotally coupled to a second end of said first linkage arm;

clamp means for releasably clamping the first and second linkage arms to maintain a predetermined angular orientation therebetween;

said second linkage arm having a first chain guide edge aligned with said drive sprocket;

said chain drive means being entrained about said drive sprocket and riding on said first chain guide edge;

said second linkage arm being movable relative to said first linkage arm between a first position wherein the first and second linkage arms are arranged to lie along a substantially straight line and a second position wherein said second linkage arm forms an angle of less than 180 degrees with said first linkage arm, said angle being defined by longitudinal axes of said first and second linkage arms.

2. The apparatus of claim 1 further comprising:

a chain support plate having a second guide edge supporting and slidably engaging said chain;

said chain support plate being fixedly secured to said first linkage arm and having its chain guide edge substantially in alignment with said drive sprocket;

said drive sprocket and said first and second supporting chain guide edges being arranged along a substantially straight line.

3. The apparatus of claim 2 wherein a free end of said second linkage arm has an arcuate shape to facilitate guiding and support of said chain drive means therearound.

4. The apparatus of claim 1 wherein said chain drive means are adapted for use with a feeder means having a plurality of rollers at said output end, said rollers being aligned to rotate about a common axis, said feeder means having support means for said rollers for providing at least first and second gap spaces between selective ones of said rollers at an output end of said feeder means;

said chain drive means comprising first and second drive chain assemblies;

means for mounting said first and second drive chain assemblies in spaced parallel fashion which spacing enables said first and second drive chain assemblies to be respectively inserted into the first and second gap spaces provided at the output end of said feeder means to facilitate alignment therebetween.

5. The apparatus of claim 4 further comprising:

means for adjusting the height of said feeder means to facilitate alignment between the input end of said sectional chain means and the output of said feeder means.

6. The apparatus of claim 2 wherein said means for removing a signature from feedrack hopper comprises swingably mounted means movable between a first position to engage a signature resting against said end wall and a second position angularly displaced from the plane of said end wall.

7. The apparatus of claim 6 wherein said swingably mounted means further comprises suction means for selectively holding a signature when in said first position.

8. A signature feedrack assembly according to claim 1 wherein said chain drive means comprises a closed-loop chain having a path defined by said sprocket and guide surfaces of said first and second linkage arms.

9. A signature feedrack assembly according to claim 8 further comprising guide means for maintaining the closed-loop chain substantially taut when said first and second linkage arms are in said second position, said curved guide means being arranged to guide said closed-loop chain about an inside corner.

10. A signature feedrack assembly according to claim 1 wherein said means for moving said chain drive means comprises pawl means for incrementally rotating said sprocket.

11. A signature feedrack assembly according to claim 1 further comprising first and second guide means each arranged in spaced parallel fashion to an associated one of said first pair of linkage arms and aligned with a chain guide edge of an associated one of said second pair of linkage arms and cooperating with said first chain guide edges to guide one of said drive chain means.

12. A signature feedrack assembly according to claim 11 wherein said first and second chain drive means are each comprised of a closed-loop chain, a path of each closed-loop chain being defined by an associated drive sprocket and associated first and second chain guide edges.

13. A signature feedrack assembly according to claim 12 further comprising guide path means for maintaining the first and second closed-loop chains substantially taut when said first and second pairs of linkage arms are arranged in said second position, said guide path means guiding an associated chain to follow a curved, inside corner.

14. A signature feedrack assembly comprising:

first and second chain drive means for supporting a variety of signatures along one edge thereof;

an end wall arranged substantially at a right angle to said chain drive means cooperating with said chain drive means for supporting a stack of signatures on end;

means for removing a signature adjacent said end wall;

means responsive to removal of a signature for moving said chain drive means through a linear distance for advancing the signatures on said chain drive means through a distance substantially equal to a width of a signature;

each of said chain drive means including a drive sprocket;

a first linkage arm;

said drive sprocket being pivotally mounted to a first end of said first linkage arm;

a second linkage arm;

a first end of said second linkage arm being pivotally coupled to a second end of said first linkage arm;

clamp means for releasably clamping the first and second linkage arms to maintain a predetermined angular orientation therebetween;

said second linkage arm having a first chain guide edge aligned with said drive sprocket;

said chain drive means being entrained about said drive sprocket and riding on said first chain guide edge;

said first linkage arm being movable relative to said second linkage arm between a first position wherein the first and second linkage arms are arranged to lie along a substantially straight line and a second

15. A signature feedrack assembly for use with conveyor means for conveying signatures to said signature feedrack assembly, said conveyor means having a downstream end terminating in a plurality of coaxially aligned roller means each supporting a conveyor belt, said roller means being arranged at spaced intervals along an axis of rotation to provide at least one clearance gap;

said feedrack assembly comprising:

chain drive means for supporting a plurality of signatures along one edge thereof;

an end wall arranged substantially at a right angle to an upper run of said chain drive means and cooperating with said chain means for supporting a stack of signatures on end;

means for removing a signature adjacent said end wall;

means responsive to removal of a signature for moving said chain drive means through a linear distance for advancing the signatures on said upper run through a distance substantially equal to a width of a signature;

said chain drive means including drive sprocket means;

a first linkage arm;

said drive sprocket means being pivotally mounted at a first end of said first linkage arm;

a second linkage arm;

a first end of said second linkage arm being pivotally coupled to a second end of said first linkage arm;

clamp means for releasably clamping the first and second linkage arms to maintain a predetermined angular orientation therebetween;

said second linkage arm having a first chain guide edge means aligned with said drive sprocket means;

said chain drive means being entrained about said drive sprocket means and riding on said first chain guide edge;

said second linkage arm being movable relative to said first linkage arm between a first position wherein the first and second linkage arms are arranged to lie along a substantially straight line and a second position wherein said second linkage arm forms an angle of less than 180 degrees with said first linkage arm, said angle being defined by longitudinal axes of said first and second linkage arms;

said second linkage arm having a free end arranged in said clearance gap when said first and second linkage arms are in said first position.

16. A signature feedrack assembly for use with conveyor means for conveying signatures to said signature feedrack assembly, said conveyor means having a downstream end terminating in a plurality of coaxially aligned roller means each supporting a conveyor belt, said roller means being arranged at spaced intervals along an axis of rotation to provide at least one clearance gap;

said feedrack assembly comprising:

chain drive means for supporting a plurality of signatures along one edge thereof;

an end wall arranged substantially at a right angle to an upper run of said chain drive means and cooperating with said chain means for supporting a stack of signatures on end;

means for removing a signature adjacent said end wall;

means responsive to removal of a signature for moving said chain drive means through a linear distance for advancing the signatures on said upper run through a distance substantially equal to a width of a signature;

said chain drive means including drive sprocket means;

a first linkage arm;

said drive sprocket means being pivotally mounted at a first end of said first linkage arm;

a second linkage arm;

a first end of said second linkage arm being pivotally coupled to a second end of said first linkage arm;

clamp means for releasably clamping the first and second linkage arms to maintain a predetermined angular orientation therebetween;

said second linkage arm having a first chain guide edge aligned with said drive sprocket;

said chain drive means being entrained about said drive sprocket and riding on said first chain guide edge;

said second linkage arm being movable relative to said first linkage arm between a first position wherein the first and second linkage arms are arranged to lie along a substantially straight line and a second position wherein said second linkage arm forms an angle of less than 180 degrees with said first linkage arm, said angle being defined by longitudinal axes of said first and second linkage arms;

wherein the first end of said second linkage arm and the second end of said first linkage arm pivotally coupled thereto lie in said clearance gap when said first and second linkage arms are in said second position, a top surface of said conveyor belts and the upper run of said chain drive means forming an angle of greater than 180 degrees.

17. A signature feedrack assembly comprising:

first and second chain drive means for supporting a variety of signatures along one edge thereof;

an end wall arranged substantially at a right angle to an upper run of said first and second chain drive means and cooperating with said first and second chain drive means for supporting a stack of signatures on end;

means for removing a signature adjacent said end wall;

means responsive to removal of a signature for moving said first and second chain drive means through a linear distance for advancing signatures on said upper run through a distance substantially equal to a width of a signature;

first and second drive sprockets for respectively driving said first and second chain drive means;

a first pair of linkage arms arranged in spaced parallel fashion;

each drive sprocket being pivotally mounted to a first end of an associated one of said pair of first linkage arms;

a second pair of linkage arms arranged in spaced parallel fashion;

a first end of each of said second pair of linkage arms being pivotally coupled to a second end of one of said first pair of linkage arms;

clamp means for releasably clamping the first and second pairs of linkage arms to maintain a predetermined angular orientation therebetween;

said second pair of linkage arms each having a first chain guide edge aligned with one of said drive sprockets;

said first and second chain drive means being respectively entrained about said first and second drive sprockets and being respectively guided along the first chain guide edge of one of said second pair of linkage arms;

said second pair of linkage arms being movable relative to said first pair of linkage arms between a first position wherein the first and second pairs of linkage arms are arranged to lie along a substantially straight line and a second position wherein said second pair of linkage arms forms an angle of less than 180 degrees with said first pair of linkage arms, said angle being defined by the longitudinal axes of said first and second pairs of linkage arms.

* * * * *

UNITED STATES PATENT AND TRADEMARK OFFICE

CERTIFICATE OF CORRECTION

PATENT NO. : 5,310,172

DATED : May 10, 1994

INVENTOR(S) : John E. Prim, David Hall, Robert Kinson and Cyrus Myers

It is certified that error appears in the above-indentified patent and that said Letters Patent is hereby corrected as shown below:

Column 19, line 7, change "R" to —$R_4$—.

Column 21, line 49, of Claim 6, change "2" to --1--.

Column 22, line 59, of Claim 14, after "second" insert --position wherein said second linkage arm forms an angle of less than 180 degrees said angles being defined by the longitudinal axes of said first and second linkage arms when said clamp is released.--

Column 24, line 25, of Claim 17, change "variety" to --plurality--.

Signed and Sealed this

Ninth Day of May, 1995

Bruce Lehman

*Attest:*

BRUCE LEHMAN

*Attesting Officer*

*Commissioner of Patents and Trademarks*